US009878200B2

(12) United States Patent
Edmondson

(10) Patent No.: US 9,878,200 B2
(45) Date of Patent: Jan. 30, 2018

(54) GRAVITY RETURN ROWING EXERCISE DEVICE

(71) Applicant: Robert Edmondson, Peterborough (CA)

(72) Inventor: Robert Edmondson, Peterborough (CA)

( * ) Notice: Subject to any disclaimer, the term of this patent is extended or adjusted under 35 U.S.C. 154(b) by 191 days.

(21) Appl. No.: 14/190,326

(22) Filed: Feb. 26, 2014

(65) Prior Publication Data

US 2014/0243163 A1 Aug. 28, 2014

Related U.S. Application Data

(60) Provisional application No. 61/850,901, filed on Feb. 26, 2013.

(51) Int. Cl.

| | |
|---|---|
| ***A63B 69/06*** | (2006.01) |
| ***A63B 21/00*** | (2006.01) |
| ***A63B 22/14*** | (2006.01) |
| ***A63B 22/20*** | (2006.01) |
| ***A63B 22/00*** | (2006.01) |
| ***A63B 21/22*** | (2006.01) |

(52) U.S. Cl.

CPC ..... *A63B 22/0076* (2013.01); *A63B 21/152* (2013.01); *A63B 21/153* (2013.01); *A63B 21/154* (2013.01); *A63B 21/227* (2013.01); *A63B 21/4015* (2015.10); *A63B 21/4035* (2015.10); *A63B 2208/0223* (2013.01)

(58) Field of Classification Search

CPC ..... A63B 21/06; A63B 21/062; A63B 22/00; A63B 22/201; A63B 22/203; A63B 22/0076; A63B 22/0087; A63B 2022/0079; A63B 69/06; A63B 2069/062; A63B 22/0089; A63B 22/208; A63B 21/0079; A63B 21/0087; A63B 21/0089

See application file for complete search history.

(56) References Cited

U.S. PATENT DOCUMENTS

| | | | | | |
|---|---|---|---|---|---|
| 232,022 | A * | 9/1880 | Gifford | A63B 21/0628 | 482/102 |
| 337,942 | A * | 3/1886 | Farley | A63B 21/0628 | 297/344.1 |
| 567,915 | A * | 9/1896 | McLarty | A63B 22/0076 | 366/239 |
| 1,928,089 | A * | 9/1933 | Blickman | A63B 17/00 | 482/102 |
| 3,558,130 | A * | 1/1971 | Anderson | A63B 21/0615 | 482/72 |
| 4,396,188 | A | 8/1983 | Dreissigacker et al. | | 482/73 |
| 4,616,825 | A * | 10/1986 | Anderson | A63B 22/0076 | 482/72 |
| 4,772,013 | A | 9/1988 | Tarlow | | 482/73 |
| 4,798,378 | A * | 1/1989 | Jones | A63B 21/0052 | 310/105 |
| 5,072,929 | A * | 12/1991 | Peterson | A63B 22/0076 | 310/105 |

(Continued)

*Primary Examiner* — Nyca T Nguyen

(74) *Attorney, Agent, or Firm* — Teitelbaum & MacLean; Neil Teitelbaum; Doug MacLean

(57) ABSTRACT

A rowing exercise device in which the return force for the rowing handle is provided by the force of gravity rather than an elastic cable. The rowing exercise device includes a stationary base and a moveable frame, which rotates or slides upwardly relative to the stationary base when a pulling force is applied to the handle, and then rotates or slides back down to the initial position under the force of gravity when the pulling force is removed.

16 Claims, 26 Drawing Sheets

(56) References Cited

U.S. PATENT DOCUMENTS

| | | | | | |
|---|---|---|---|---|---|
| 5,085,429 | A * | 2/1992 | Van Der Hoeven | A63B 21/0004 | 482/130 |
| 5,382,210 | A | 1/1995 | Rekers | | 482/72 |
| 5,470,295 | A * | 11/1995 | Wang | A63B 21/068 | 482/71 |
| 5,626,541 | A * | 5/1997 | Ramlogan | A63B 21/0628 | 482/142 |
| 5,779,600 | A | 7/1998 | Pape | | 482/72 |
| 5,906,564 | A * | 5/1999 | Jacobsen | A63B 21/068 | 482/135 |
| 5,916,069 | A * | 6/1999 | Wang | A63B 21/153 | 482/57 |
| 6,926,647 | B1 * | 8/2005 | Huang | A63B 21/0552 | 482/115 |
| 6,991,589 | B1 * | 1/2006 | Patterson | A63B 21/0088 | 482/142 |
| 7,862,484 | B1 | 1/2011 | Coffey | | 482/72 |
| 8,038,582 | B2 | 10/2011 | Edmondson | | 482/72 |
| 2002/0132706 | A1 * | 9/2002 | Sleamaker | A63B 21/068 | 482/51 |
| 2005/0085348 | A1 * | 4/2005 | Kiefer | A63B 22/0076 | 482/72 |
| 2011/0028278 | A1 | 2/2011 | Roach | | 482/72 |
| 2012/0094804 | A1 * | 4/2012 | Bell | A63B 21/00069 | 482/8 |
| 2013/0035216 | A1 * | 2/2013 | Campbell | A63B 22/0076 | 482/72 |
| 2014/0296044 | A1 * | 10/2014 | Kucharski | A63B 21/00185 | 482/131 |

* cited by examiner

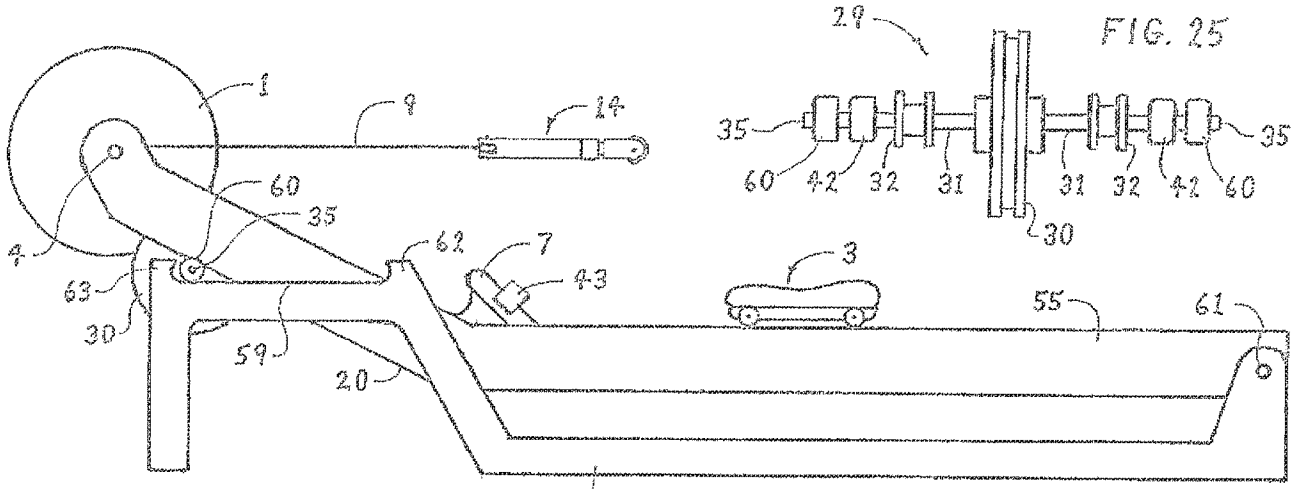
FIG. 24
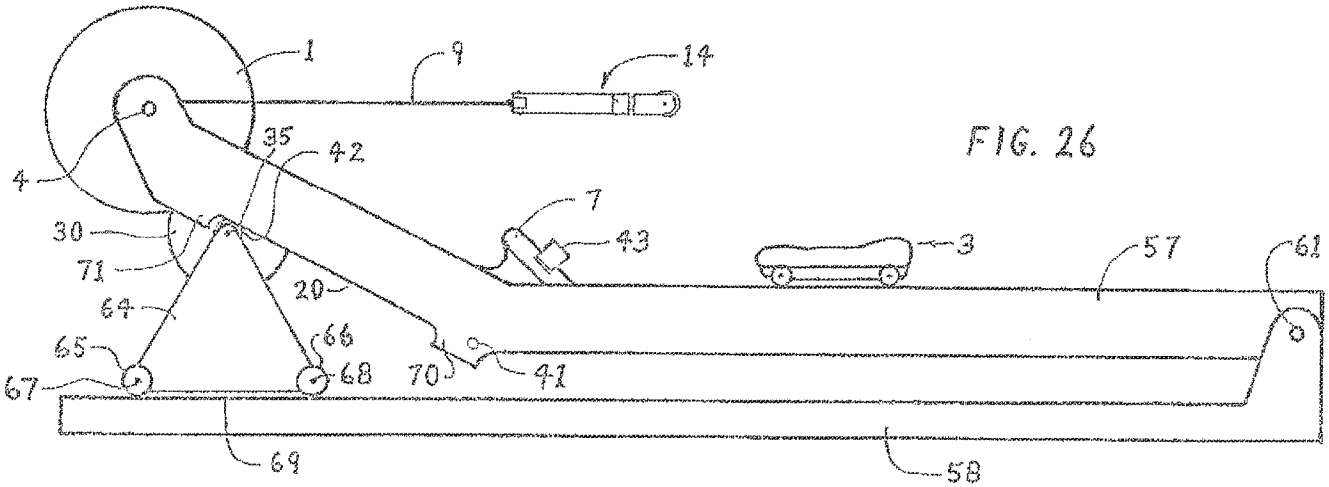

GRAVITY RETURN ROWING EXERCISE DEVICE

CROSS-REFERENCE TO RELATED APPLICATIONS

The present invention claims priority from U.S. Provisional Patent Application No. 61/850,901 filed Feb. 26, 2013, which is incorporated herein by reference.

TECHNICAL FIELD

The present invention relates to an exercise device, and in particular to a rowing exercise device that utilizes a flywheel as a resistance source.

BACKGROUND OF THE INVENTION

Conventional rowing exercise devices, which utilize a flywheel as a resistance source, are mechanically simple, whereby the rotational inertia of the flywheel provides a good replication of the resistance experienced during actual rowing. Nevertheless, in the prior art devices the mechanically simple devices are still more complex than they need to be.

FIGS. 1 and 2 illustrate a conventional flywheel-type rowing exercise device with a chain take-up and handle return, in which a stationary base 2, with ground engaging legs and feet, supports a flywheel 1 rotatably mounted at one end, and a seat 3, which is slideable on the base 2 from an end opposite the flywheel 1 to a position midway between the two ends. A shaft 4, to which is fixed a sprocket or pulley 5, is rotatably and transversely mounted on a raised front portion of the base 2 on which the flywheel 1 is mounted, and freely rotates in one direction. The seat 3 is free to slide or roll fore and aft on a seat rail 6 mounted longitudinally on the frame 2.

The user sits on the seat 3, places their feet on footrests 7 and grasps a handle 8. The handle 8 is connected to a rope 9, which passes around sprocket or pulley 5 and then is routed around and between a multiplicity of pulleys or sprockets 13, around moveable pulley assembly 11, and fixed to fixed pulley assembly 11. The moveable pulley assembly 11 is connected to an elastic cord or spring 12, which is routed around and between pulleys 13 and fixed at both ends to the base 2.

Pulling on the handle 8 pulls the rope 9 around sprocket or pulley 5, which causes the flywheel 1 to rotate and the moveable pulley assembly 11 to move towards the fixed pulley assembly 10. This in turn causes elastic cord 12 to elongate under tension, which is accommodated by the rotation of pulleys 13. Upon return of the handle 8, a uni-directional clutch in the hub of the flywheel 1 disengages, allowing the flywheel 1 to continue to rotate. The slack of the chain 9 is taken up by the return of the moveable pulley 11 to its rest position through the force of contracting the elastic cord 12.

Variations of this chain delivery and take-up means have been utilized in a multitude of prior art flywheel-type rowing exercise devices, such as the ones disclose in U.S. Pat. No. 4,396,188 entitled "Stationary Rowing Unit", issued in 1983 to Dreissigacker; U.S. Pat. No. 5,382,210, entitled "Dynamically Balanced Rowing Simulator", issued in 1995 to Rekers; U.S. Pat. No. 5,779,600, entitled "Rowing Simulator", issued in 1998 to Pape; U.S. patent application Ser. No. 12/796,357, entitled "Dynamic Rowing Machine", filed by Roach; and U.S. Pat. No. 7,862,484, entitled "Folding Exercise Rowing Machine", issued in 2011 to Coffey.

Unfortunately, for all of these prior art devices, repeated elongation of the elastic cord, e.g. 12, used to provide a biasing force on the chain, eventually results in a loss of elasticity of the cord, and subsequent loss of the force required to briskly take up the chain during the return (recovery) portion of the stroke. Typically, these exercise devices provide a means to adjust the tension of the spring or elastic cord when this occurs, but eventually the elastic element must be replaced.

Additionally, the elasticity of an elastic cord is affected by temperature. An exercise device which incorporates an elastic cord does not function properly in an unheated area in a cold climate. The elasticity of the cord decreases with a decrease in ambient air temperature, resulting in a sluggish chain take-up and a too slow handle return.

Also, differences in elasticity and tension of the elastic cord from one device to another results in differences of force required to move the handle. User competitions on flywheel-type rowing exercise devices have become popular, with worldwide age rankings and records. It could reasonably be argued that all such competition results and records are invalid because of the possibility of tension differences of the elastic element from one device to another. A competitor using a device with an elastic cord adjusted to a lower tension than the devices of the other competitors (but still sufficient to return the handle briskly) will have an indisputable advantage.

Finally, the prior art labyrinthine configurations of chain and elastic cord, and the multitude of pulleys, sprockets, bearings, brackets, and shafts required in these assemblies, are at odds with the essentially simple concept of a flywheel-type rowing exercise device, i.e. pull on a handle, spin a flywheel, return the handle, repeat.

U.S. Pat. No. 4,772,013 issued in 1988 to Tarlow, attempts to eliminate the elastic element in the chain take-up and handle return means by the use of a continuous chain and cable loop that passes around the flywheel sprocket and around and between fixed pulleys and sprockets positioned fore and aft on the device. The handle is secured in the middle of the exposed upper horizontal section of the chain/cable loop. However, the disclosed and functionally necessary three point chain/cable connection to the handle would seem to limit the handle design to a monolithic, rigid structure. Thus it would be unworkable, or at best awkward, to attempt to combine the Tarlow chain take-up and delivery system with the "Articulated Handles for Rowing Exercise Devices", U.S. Pat. No. 8,038,582 issued in 2011 to Edmondson.

An object of the present invention is to overcome the shortcomings of the prior art by providing a simpler pulley return system using the force of gravity instead of an elastic cord.

SUMMARY OF THE INVENTION

Accordingly, the present invention relates to a rowing exercise device comprising:

- a base having a raised front end and a lower rear end;
- a user-supporting seat slideable on the base;
- footrests for receiving a user's feet on the base;
- a rotational inertia device for providing resistance to the user during use rotatable about a first shaft;
- a handle for grasping by the user connected on an end of a cable, which engages the first shaft, for rotating the rotational inertia device upon application on a rearwardly directed force by the user, the handle and the cable being moveable between a retracted rest position and an extended use position upon application of the force by the user, thereby simulating rowing; and a force transfer assembly connected on another end of the cable for transferring the force applied to the handle to a weight forcing the weight to move upward through a vertical distance;

wherein release of the force on the handle results in the weight to move back down the vertical distance under the force of gravity resulting in the force transfer assembly returning the cable to the inner rest position.

BRIEF DESCRIPTION OF THE DRAWINGS

The invention will be described in greater detail with reference to the accompanying drawings which represent preferred embodiments thereof, wherein:

FIG. 24 is a side view of a seventh embodiment of the rowing exercise device of the present invention.

FIG. 25 depicts the chain drum, strap drums, wheels, and shaft assembly utilized in the FIG. 24 embodiment.

FIG. 26 is a side view of an eighth embodiment of the rowing exercise device of the present invention.

DETAILED DESCRIPTION

Figure 3:
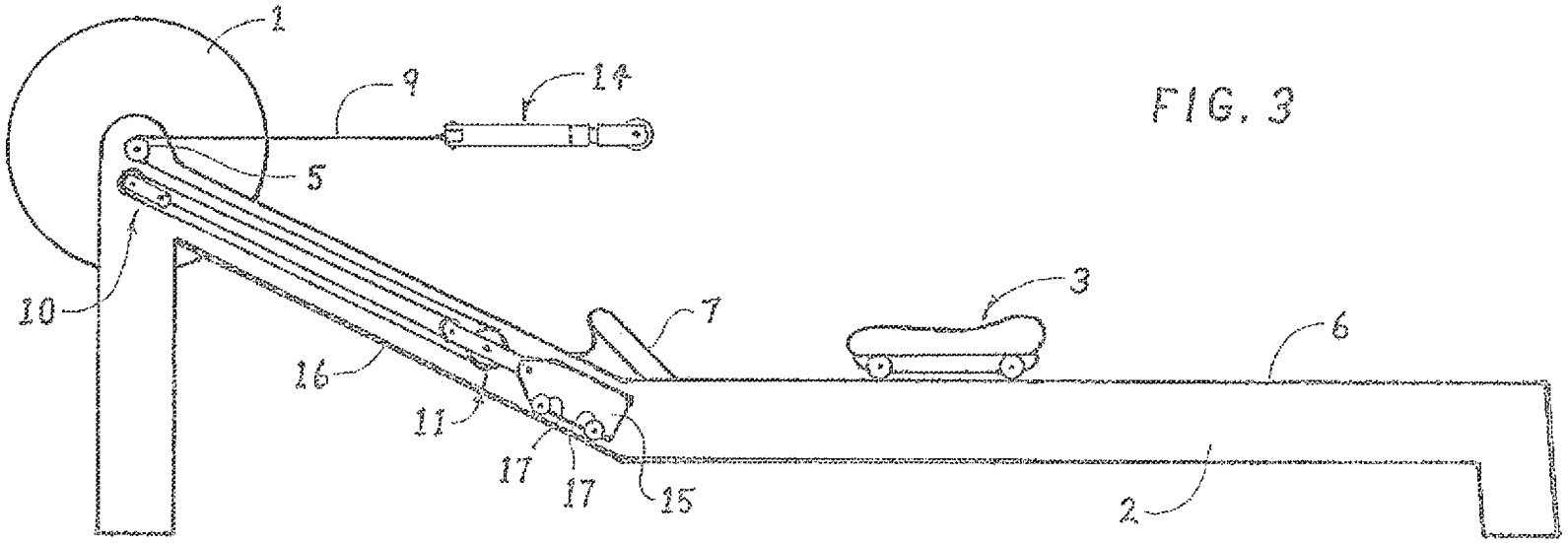
FIG. 3 is a side view which depicts the interior mechanism of a rowing exercise device that utilizes a weight to provide the required chain take-up and handle return force in accordance with a first embodiment of the present invention.

FIG. 3 is a side view of a rowing exercise device, in accordance with the present invention, in which, as above, a stationary base 2 includes ground engaging legs and feet for supporting a rotational inertial device, e.g. flywheel, 1 at one end, and a seat 3, which is slideable on the base 2 from an end opposite the flywheel to a position midway between the two ends. The rotational inertia device can take any form, e.g. from a solid or a liquid flywheel, and will hereinafter be referred to as "flywheel". A shaft 4, to which is fixed a sprocket or pulley 5, is rotatably and transversely mounted on a raised front portion of the base 2 on which the flywheel 1 is mounted and freely rotatable in one direction. The seat 3 is free to slide or roll fore and aft on a seat rail 6 mounted longitudinally on the base 2.

The user sits on the seat 3, places their feet on footrests 7 and grasps a handle 14. The handle 14 is connected to a cable 9, (which could include any chain, belt, cord, rope or other suitable flexible connector) which passes around sprocket or pulley 5 and then is routed to a force transfer assembly. In this embodiment, the cable 9 passes around and between a plurality of pulleys or sprockets rotatably mounted on the base 2, around a moveable pulley assembly 11, and is fixed to a fixed pulley assemblies 10. In contrast to the prior art, the moveable pulley assembly 11 is connected to a sliding weight 15 to provide the required chain take-up and handle return force, rather than the elastic cord 12 of the prior art. The remainder of the cable/pulley 9/10/11 configuration can remain unchanged or include any suitable arrangement.

Pulling on the handle 14, e.g. such as the one disclosed in U.S. Pat. No. 8,038,582, issued to Edmondson in 2011, causes the moveable pulley block 11 to move towards the fixed pulley block 10. The weight 15, which is connected to moveable pulley block 11, is therefore pulled up an inclined plane 16 with a slope, e.g. 10° to 90° slope (i.e. vertical), but preferably, at an acute angle between 15° and 85°, more preferably at less than 45°, and even more preferably 15° to 30° to horizontal, on wheels or rollers 17 or other low friction surface, e.g. teflon. When the handle 14 is at the fully extended position and the user's force is released, the force of gravity causes the weight 15 to roll/slide back down inclined plane 16, taking up the slack of chain 9 and assisting in the return of handle 14 to the retracted position.

This change eliminates all of the deficiencies of conventional springs or elastic cords 12. The handle return force will never go out of adjustment, and since gravity never wears out, the weight 15 will never need to be replaced. It would also provide unvarying and equal handle return force on all rowing exercise devices so equipped, ensuring fairness in competitions. If variations in workout intensity are desired, weight 15 could be of a segmented or variable design to enable users to increase or decrease the amount weight 15 to suit individual preference.

The handle return force of flywheel-type rowing exercise devices is typically about seven pounds. Therefore, by way of example, if the user of the device pulls the handle 14 a distance of 60", and if through the force transfer assembly this causes weight 15 to move through a vertical distance of 6", this is a 10:1 ratio. It follows that to obtain a seven pound handle return force, in this example weight 15 would need to be 70 pounds. However, any suitable amount of weight, e.g. 50 to 150 pounds, is possible, depending on the slope of the inclined plane 16, the coefficient of friction between the weight 15 and the inclined plane 16, and the individual user's requirements.

This weight requirement may be objectionable to individual owners and users of these devices, but in a commercial gym environment the weight requirement would probably be of no consequence. Commercial gyms commonly have an inventory of standard barbell plates. Accordingly, weight 15 in FIG. 3 could be replaced with a simple carriage, which would accept standard barbell plates, thereby enabling the user to change the handle return force by the simple expedient of adding or removing barbell plates.

Figure 1:
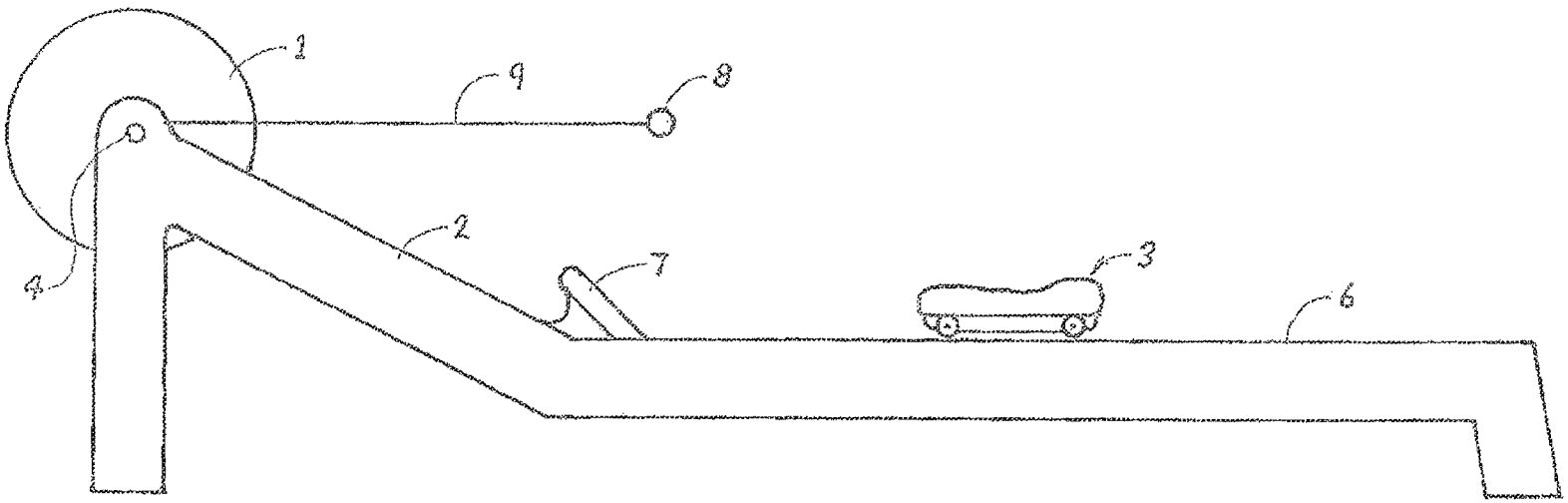
FIG. 1 PRIOR ART
FIG. 1 is a side view of a typical prior art rowing exercise device that utilizes a flywheel as a resistance source.
Figure 2:
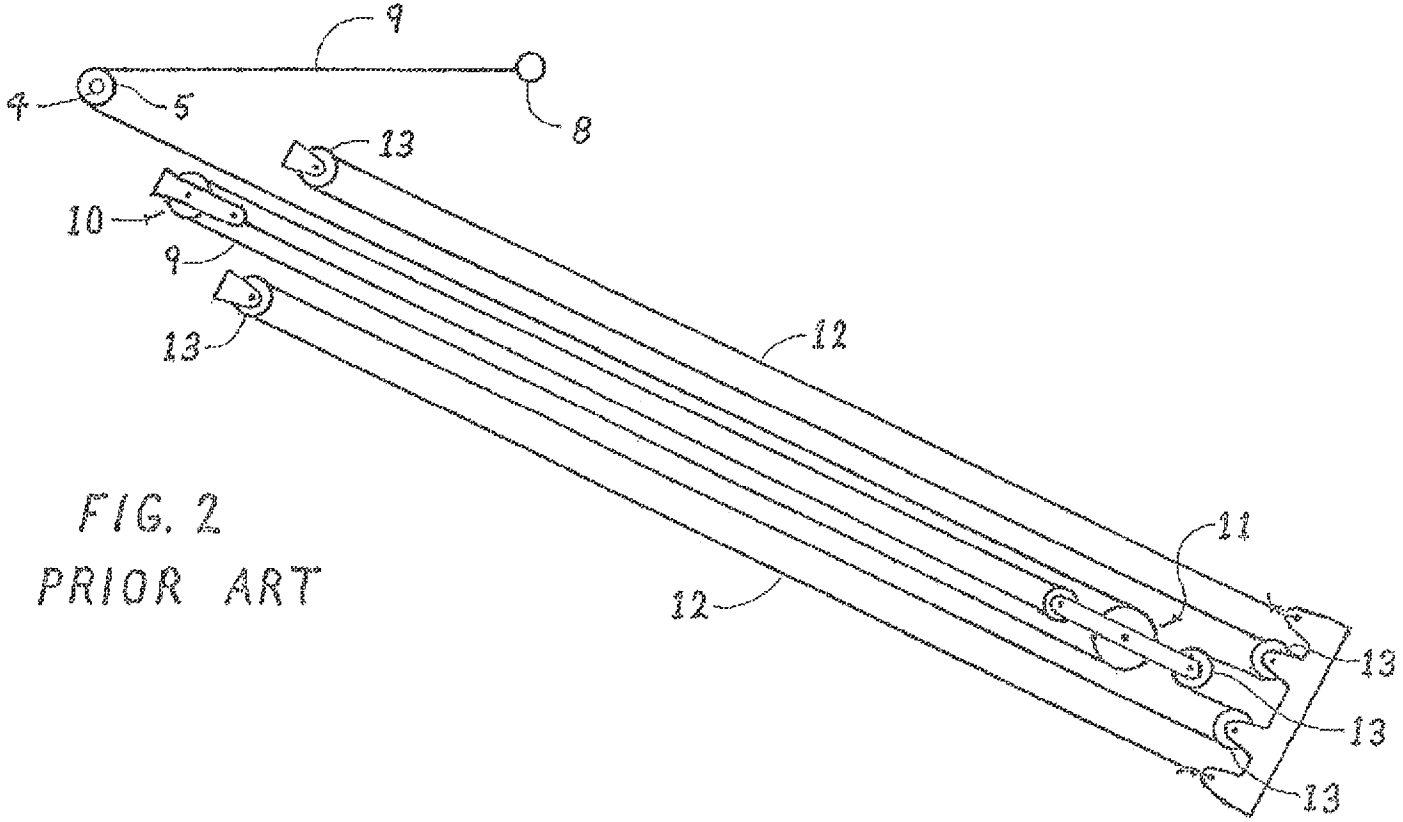
FIG. 2 PRIOR ART
FIG. 2 depicts a typical prior art chain take-up and handle return means utilized in the type of rowing exercise device of FIG. 1.
Figure 4:
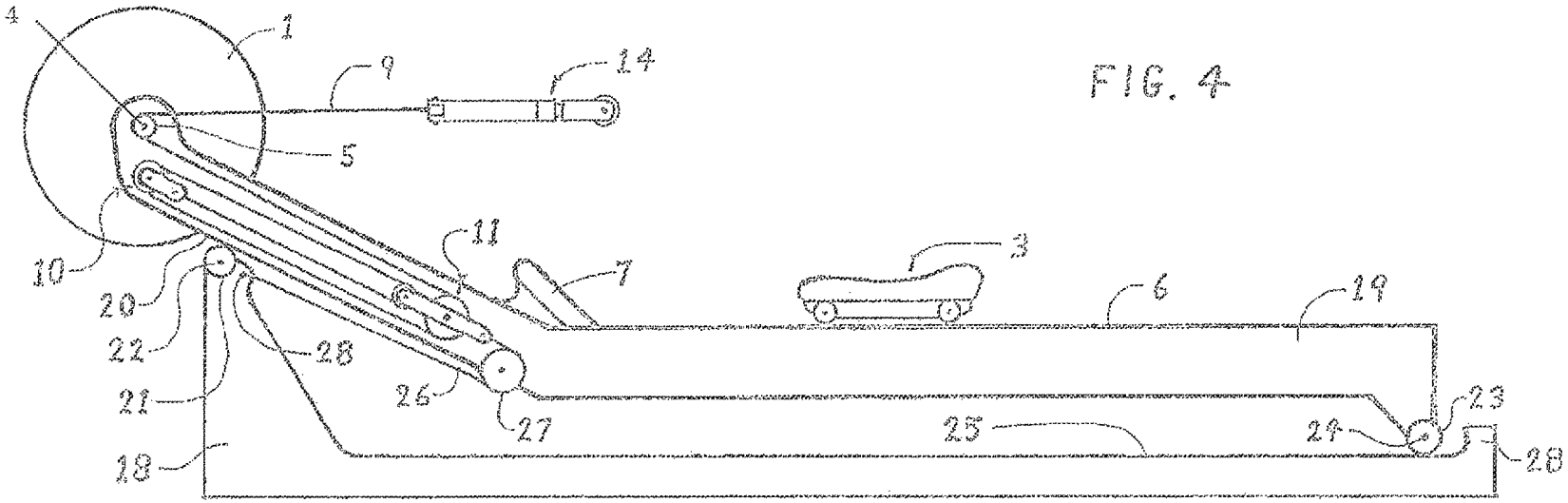
FIG. 4 is a side view which depicts the interior mechanism of a rowing exercise device that utilizes part of the weight of the device and of the user to provide the required chain take-up and handle return force in accordance with a second embodiment of the present invention.

FIG. 4 illustrates another embodiment of a rowing exercise device of the present invention in which an interior return mechanism also utilizes a weight to provide the required chain take-up and handle return force. However, in this embodiment, the weight utilized is a portion of that of the device itself, and a portion of the weight of the user on the device. To facilitate this, the frame of the device is comprised of two parts: a stationary base 18, and a moveable frame 19 slideable relative to and on the base 18. As in FIG. 3, the force transfer assembly includes the chain/pulley configuration 9/10/11 illustrated in FIG. 2, mounted on the moveable frame 19, with the elastic cord 12 replaced by a cable 26 fixed between the moveable pulley block 11 and the stationary base 18.

Left and right parallel front sloped tracks 20 (see FIGS. 8 and 9) integral with or mounted on the underside of each side of the moveable frame 19, bear on left and right wheels 21 rotatably mounted on a shaft 22, which is mounted transversely at the top of a raised front section of the stationary base 18. At the rear of the moveable frame 19, left and right wheels 23 (or other low friction element) are rotatably mounted on a transverse shaft 24 and bear on left and right horizontal parallel tracks 25 which are integral or otherwise mounted on to the stationary base 18.

Applying a rearwardly directed force on the handle 14 pulls the cable 9 rotating the sprocket 5 and the shaft 4, causing the flywheel 1 to rotate, and results in the moveable pulley block 11 to move towards the fixed pulley block 10. One end of the cable or strap 26 is connected to the moveable pulley block 11, whereas a middle section passes 180° around a fixed pulley 27. The other end of the cable 26 is fixed at a point 28 to the stationary base 18. Accordingly, during use, the moveable frame 19 is pulled up the front sloped tracks 20 on the wheels 21 and forward along the rear tracks 25 on the wheels 23. This movement lifts a portion of the weight of the moveable frame 19 and a portion of the weight of the user on the device through a vertical distance (similar to embodiment of FIG. 6).

Releasing the pulling force on the handle 14 and returning the handle 14 to the retracted position (similar to embodiment of FIG. 5) causes, by the force of gravity, the moveable frame 19 to roll back down the front sloped tracks 20 and along the rear tracks 25. Rearward movement of the moveable frame 19 pulls on the cable 26, which pulls on the moveable pulley block 11, thereby taking up the slack of the cable 9 and assisting in the return of handle 14 to the retracted position. The rearward movement of the moveable frame 19 and attendant descent of the front of same, is limited by a stop on the base 18, preferably left and right stops 28 integral with or mounted on the rearward ends of left and right tracks 25.

With reference to FIGS. 5 to 17, a third embodiment of the present invention is similar to the embodiment illustrated in FIG. 4, in that a portion of the weight of the device and of the user on the device is lifted through a vertical distance by pulling on handle 14. However, the FIG. 4 embodiment, although it eliminates the prior art elastic element 12 in the cable take-up means, still retains the labyrinthine chain configuration and the plurality of pulleys 10, 11 and 13 utilized in prior art rowing exercise devices. The third embodiment further simplifies the force transfer assembly by eliminating the prior art plurality of pulleys and replacing them with a simple force transfer assembly 29 depicted in FIGS. 8 and 11 to 14.

Figure 8:
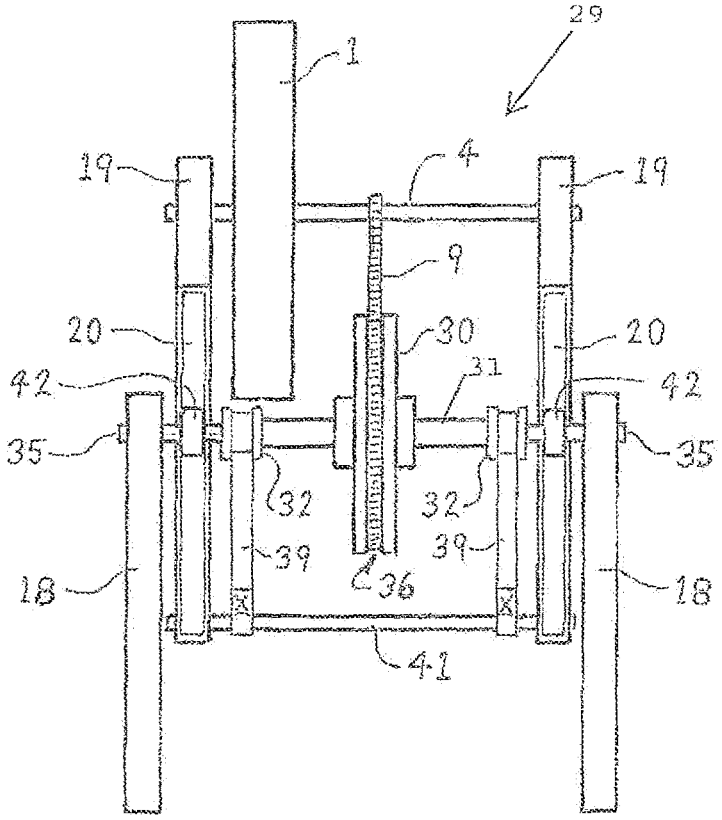
FIG. 8 is a front view of the embodiment of FIGS. 5 to 7.
Figure 9:
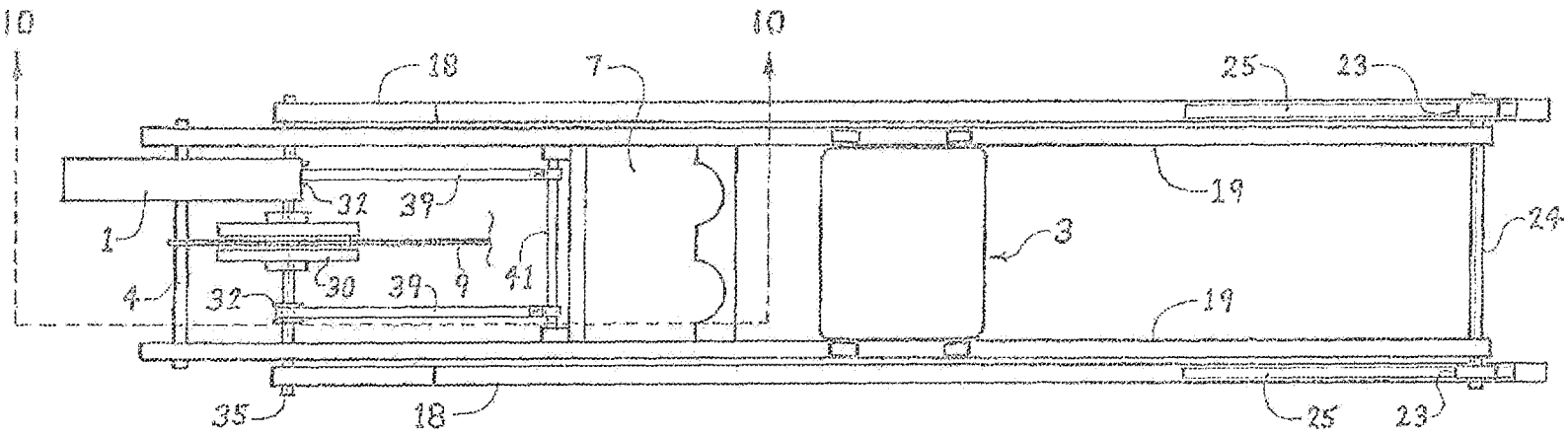
FIG. 9 is a top view of the embodiment of FIGS. 5 to 7.

With reference to FIGS. 8 and 9, the force transfer assembly 29 is comprised of a take up reel, in the form of a chain drum or sprocket 30 with a metal tube 31, at least one, e.g. left and right, strap drums 32, and a shaft 35. The chain drum 30 is mounted concentrically on the metal tube 31 at approximately the mid-point along the length thereof and of the shaft 35. The left and right strap drums 32 are axially fitted on the ends of metal tube 31, equidistant from chain drum 30. The chain drum 30 and the strap drums 32 are fixed to the metal tube 31 with pins 33 and set screws 34, respectively, so that they will rotate as a unit. That is, torque imparted to the chain drum 30 will be imparted without slippage to the strap drums 32, and vice-versa. The chain drum 30, the strap drums 32, and the metal tube 31 are axially mounted on the shaft 35 and can be either fixed or free to rotate thereon.

Figure 11:
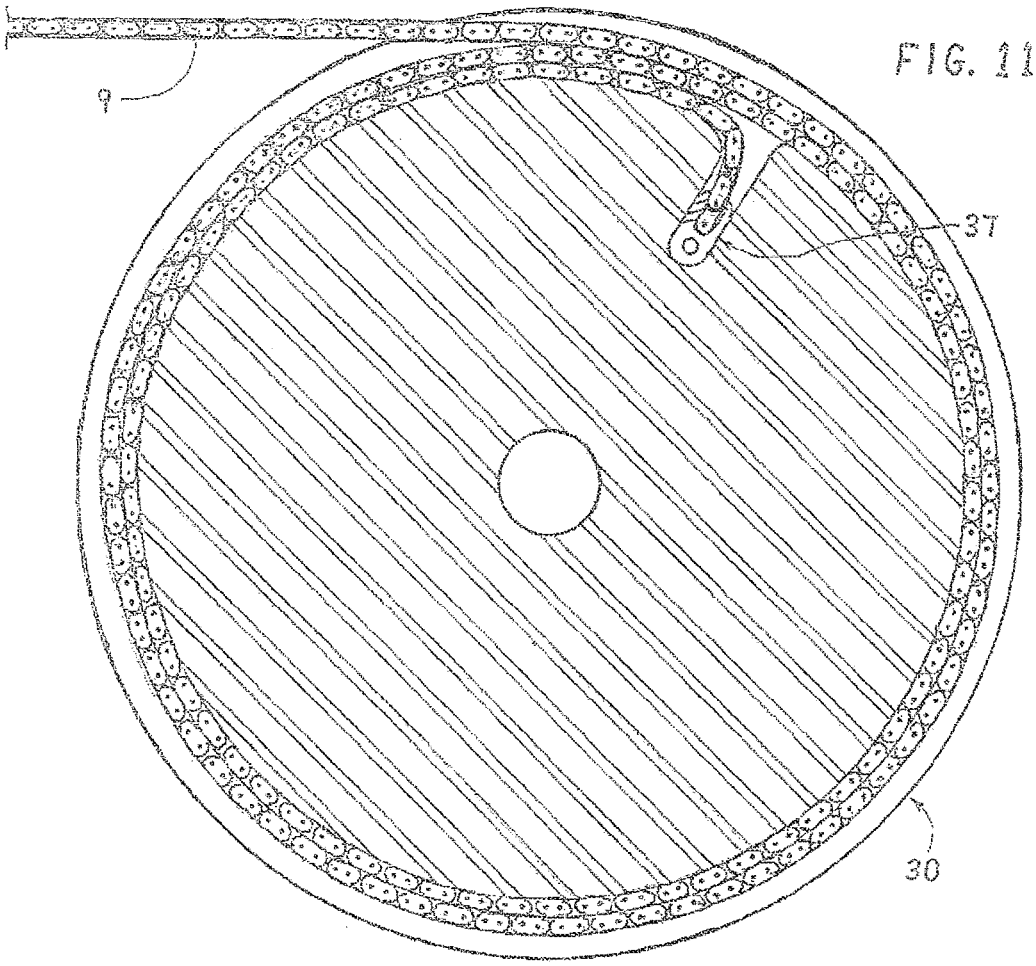
FIG. 11 is a sectional view of a chain drum that is utilized in the embodiment of FIGS. 5 to 7.

FIG. 11, a sectional view of the chain drum 30, illustrates the single layer spiral winding by which the cable 9, i.e. in this case a chain, is wrapped upon itself on the chain drum 30. Preferably the diameter of chain drum 30 is sufficiently large (9" to 12") so that only two to four rotations of chain drum 30 are required to take-up and deliver the chain length needed for a typical rowing stroke.

Figure 12:
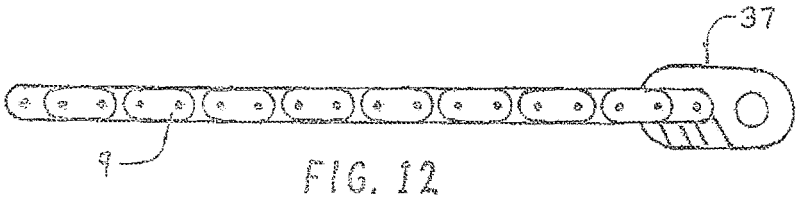
FIG. 12 depicts the preferred link profile of the chain used with the FIG. 11 chain drum.
Figure 13:
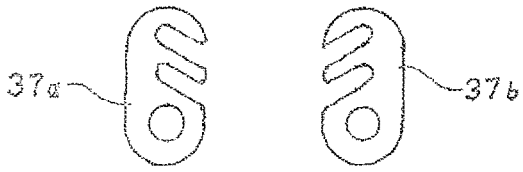
FIG. 13 depicts a fitting used to secure one end of the chain to the FIG. 11 chain drum.
Figure 14:
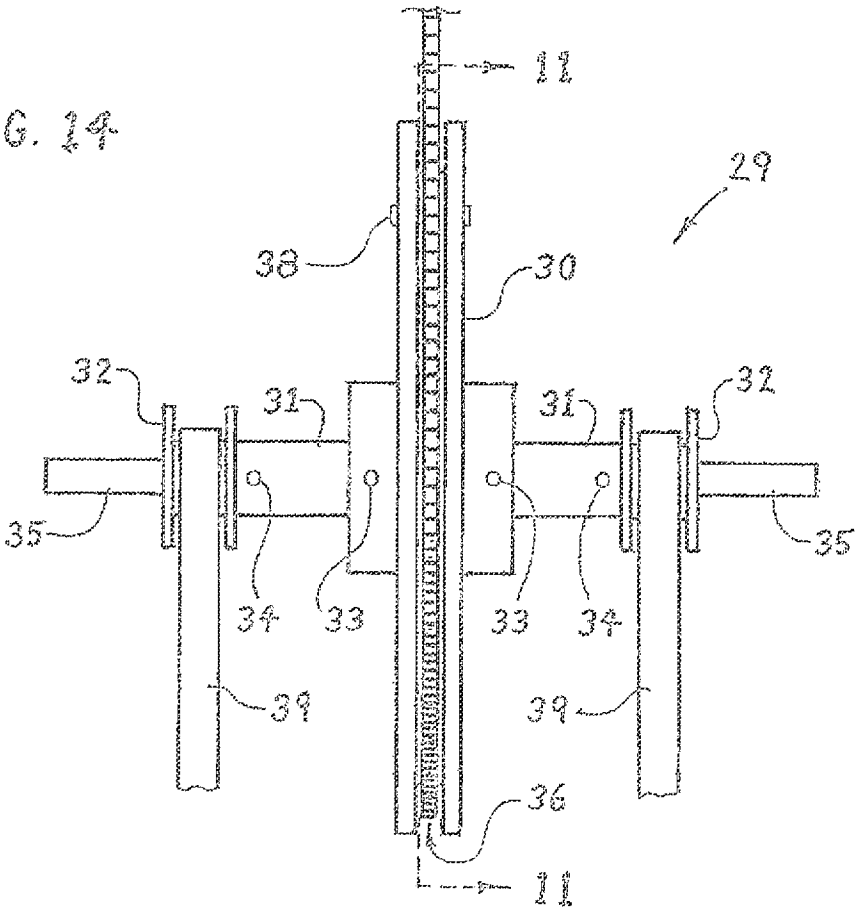
FIG. 14 depicts an assembly comprised of a large diameter chain drum and two small diameter strap drums which are fitted to a shaft utilized in the embodiment of FIGS. 5 to 7.

The perception that wrapping and unwrapping a roller-link chain upon itself will result in a rough and noisy action is incorrect. Adherence to the following three specifications will ensure that such action is smooth and quiet:

The chain 9 must have a link pattern and side profile as depicted in FIG. 12. The two long edges of each link are flat and parallel. The resulting assembled chain does not have the wavy edges typical of many drive chains wherein the links have a modified hourglass side profile. The flat edge profiled chain ensures that the chain will wrap smoothly upon itself in this application. It is readily available in the #25 (¼" pitch) chain that is commonly used in flywheel-type rowing exercise devices. Secondly, the width of the perimeter chain groove 36 provide in chain drum 30 must be sized to allow a close tolerance slip fit of the width of the chain 9 into and out of the groove 36 to ensure that the flat edges of the chain links bear directly on those below as chain 9 wraps and unwraps on the chain drum 30. Thirdly, the bottom of chain groove 36 must follow a constant and gradually changing radius path as illustrated in FIG. 11 to ensure an aberration free spiral wrapping of chain 9 on chain drum 30.

The chain end fitting 37 depicted in FIG. 12 is comprised of two identical shaped flat metal plates 37*a* and 37*b* (FIG. 13), which slide from opposite sides and engage the last two cross pins of chain 9. Similar chain end fittings 37 are used in some prior art exercise devices. In certain disclosed embodiments herein, the fitting 37 provides a practical means to utilize a through bolt 38 to terminate and secure one end of the chain 9 to the chain drum 30, as shown in FIGS. 10 and 11.

Figures 15, 16, 17:
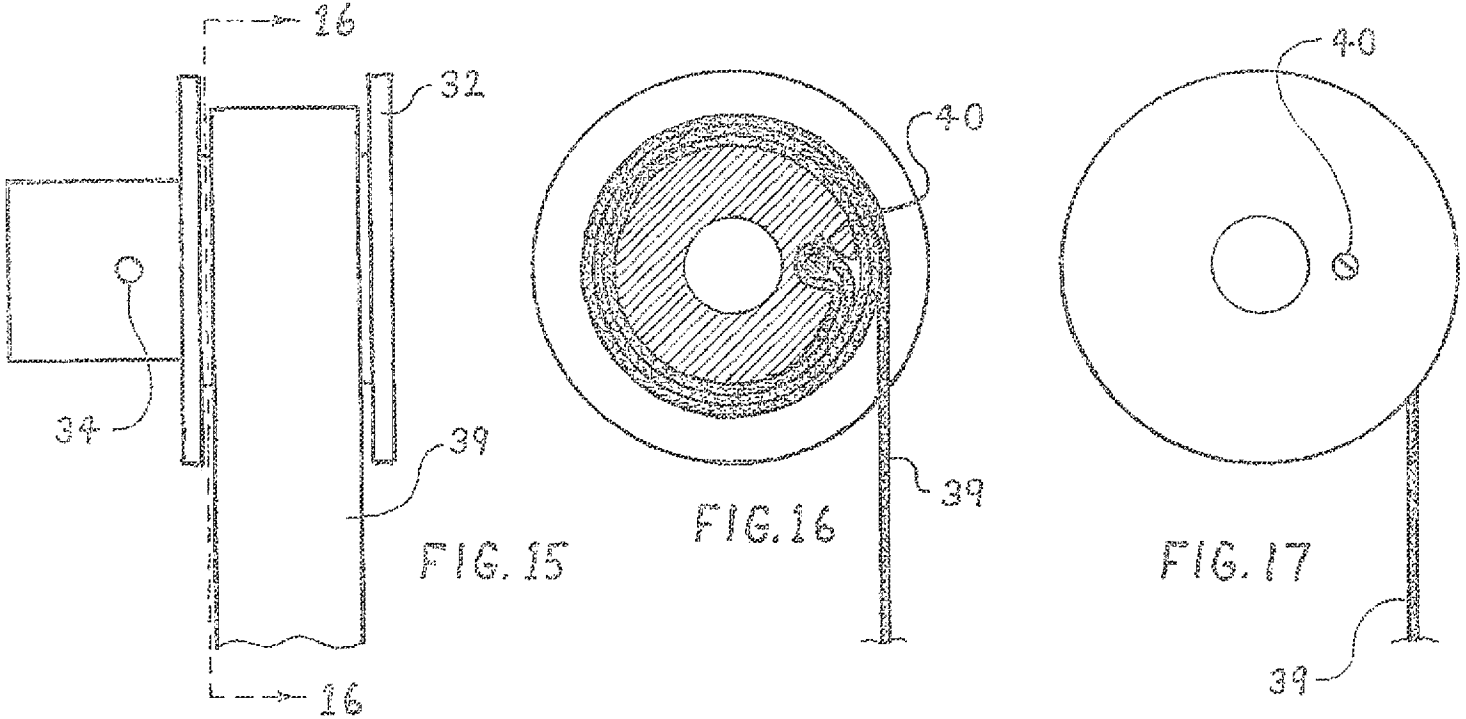
FIG. 15 is a side view of one of the strap drums depicted in FIG. 14.
FIG. 16 is a sectional view of the FIG. 15 strap drum.
FIG. 17 is an end view of the FIG. 15 strap drum.

FIGS. 15, 16, and 17 show structural details of the strap drums 32. The straps 39, comprised of a flexible, strong, non-elastic material, are spiral wrapped around the left and right strap drums 32. The end of each strap 39 is secured to its respective strap drum 32 by a pin 40 as illustrated.

Figure 7:
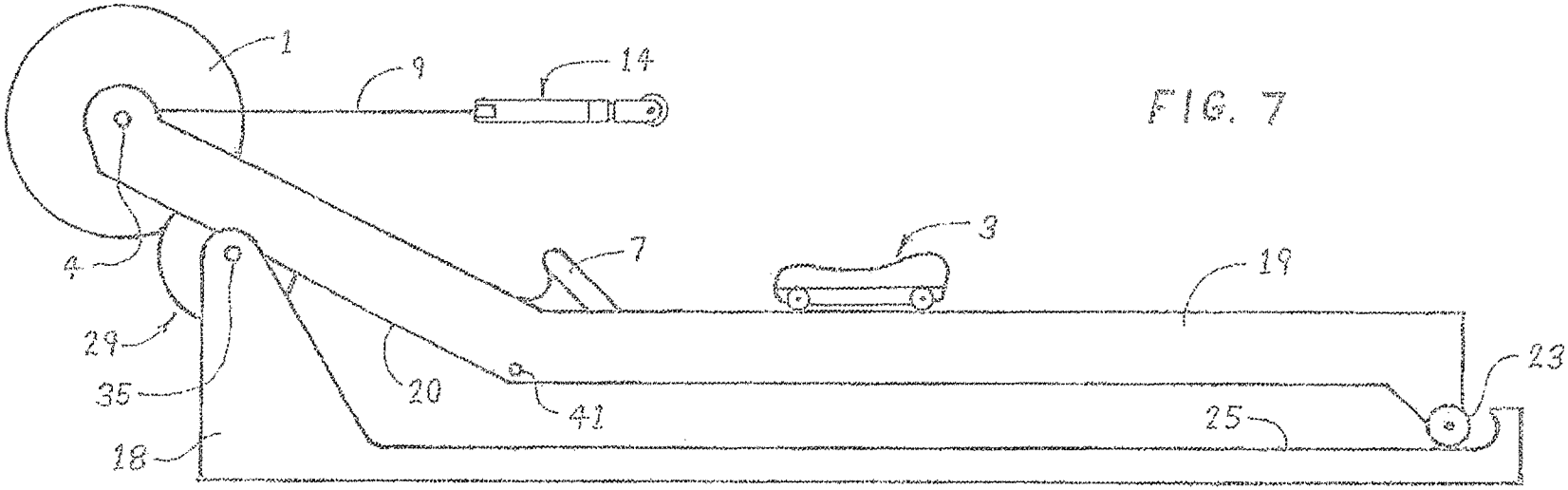
FIG. 7 is a side view of the embodiment of FIGS. 5 to 7.
Figure 10:
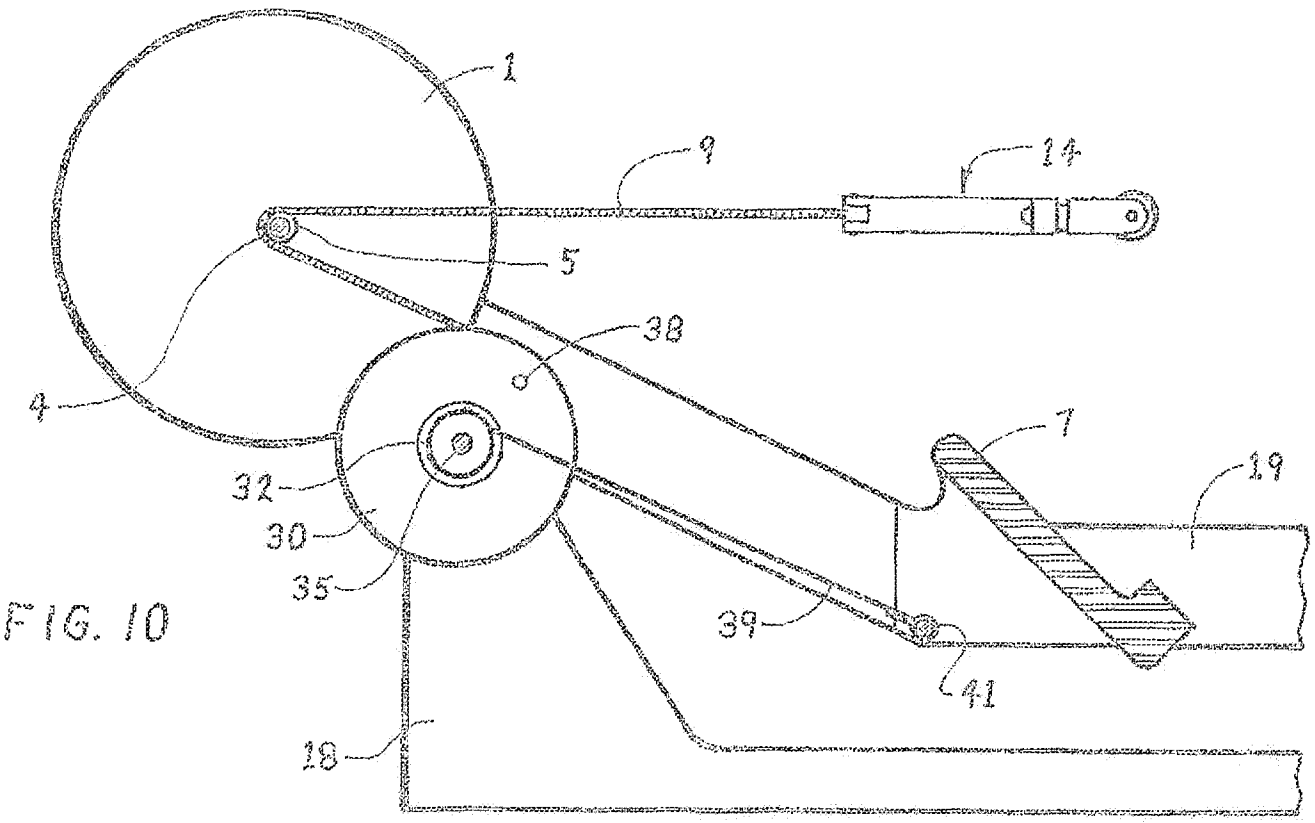
FIG. 10 is a sectional view of the embodiment of FIGS. 5 to 7.

Referring to FIG. 10 sectional side view of the front portion of the rowing exercise device of FIGS. 7, 8, and 9. The force transfer assembly 29 is transversely mounted at the top of the front raised section of stationary base 18, with the outer ends of the shaft 35 rotatably mounted to the left and right sides of the raised section. The second end of each of the straps 39 is terminated at a bar 41, which is transversely fixed in a low position on the moveable frame 19.

Pulling on the handle 14 pulls on the chain 9, which causes the chain drum 30 and the strap drums 32 to rotate together. This rotation unwraps and delivers the chain 9 as the user moves towards the extended use position, while simultaneously wrapping and taking up the left and right straps 39 on to the strap drums 32. Since the straps 39 are fixed to moveable frame 19 at the transverse bar 41, the moveable frame 19 rolls forward on the wheels 23 along the horizontal tracks 25, and up the left and right sloped tracks 20 on the left and right wheels 42 (see FIG. 8), which are rotatably mounted on the shaft 35 on the outside of the strap drums 32.

As the force is released and the handle 14 is returned to the refracted rest position, the force of gravity pulls the frame 19 back down the sloped tracks 20 and back along the horizontal tracks 25, thereby placing tension on and unwrapping straps 39 from strap drums 32, causing strap drums 32 and chain drum 30 to rotate together. The slack of chain 9 is thus taken up as chain 9 wraps onto rotating chain drum 30, thereby also assisting in the return of handle 14.

On the pull stroke the spiral unwrapping of the chain 9 from chain drum 30, and the spiral wrapping of left and right straps 39 onto left and right strap drums 32, results in a slight reduction of mechanical advantage as the effective radii of the drums change, but this reduction of mechanical advantage is offset by the shift of the user's weight rearward on the device as the stroke progresses. The fortuitous result is an almost constant handle return force throughout the stroke.

In certain disclosed embodiments, the static handle return force is affected by the user's weight on the moveable frame 19. At rest, the handle return force will be less with a lighter weight user than with a higher weight user, but this does not impair the functionality of the chain take-up and handle return means, under dynamic conditions.

Figure 5:
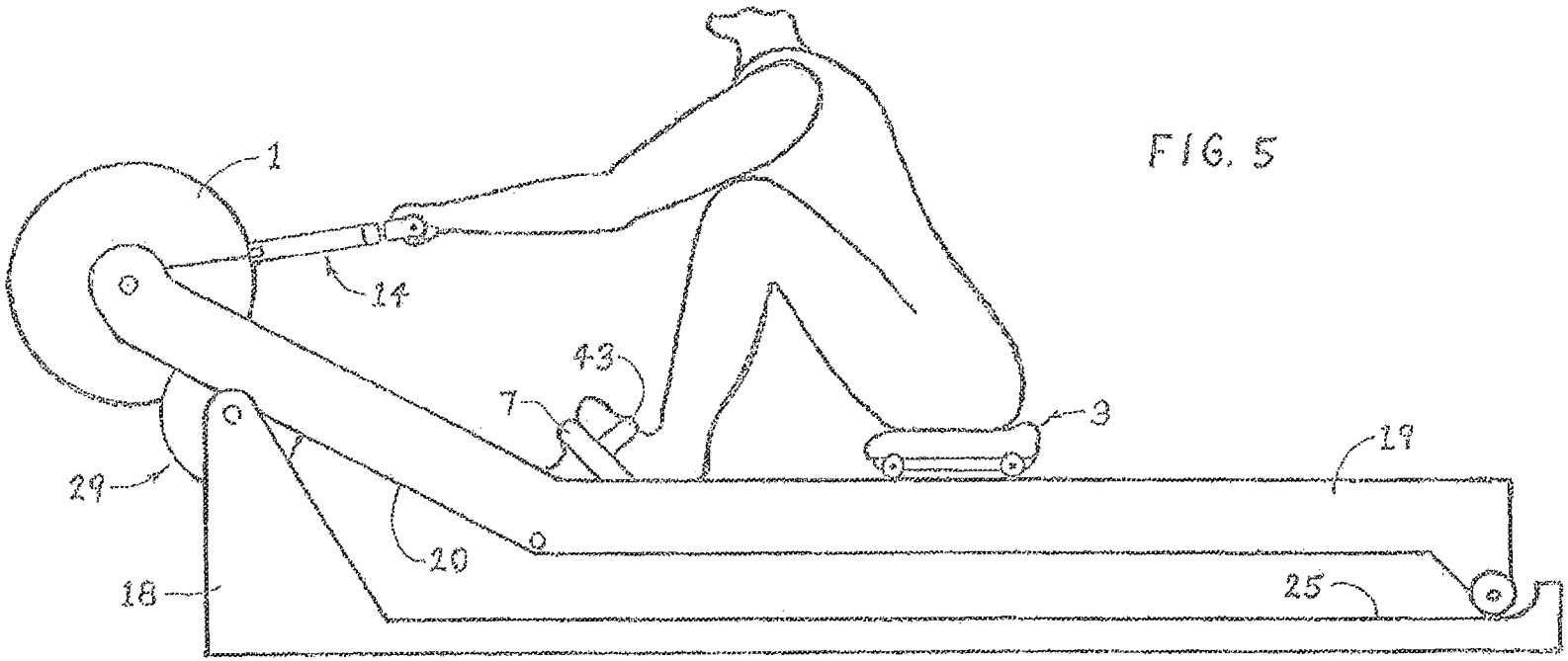
FIG. 5 is a side view of a third embodiment of the rowing exercise device of the present invention which depicts the position of the device and of the user on the device at the beginning of the rowing stroke.
Figure 6:
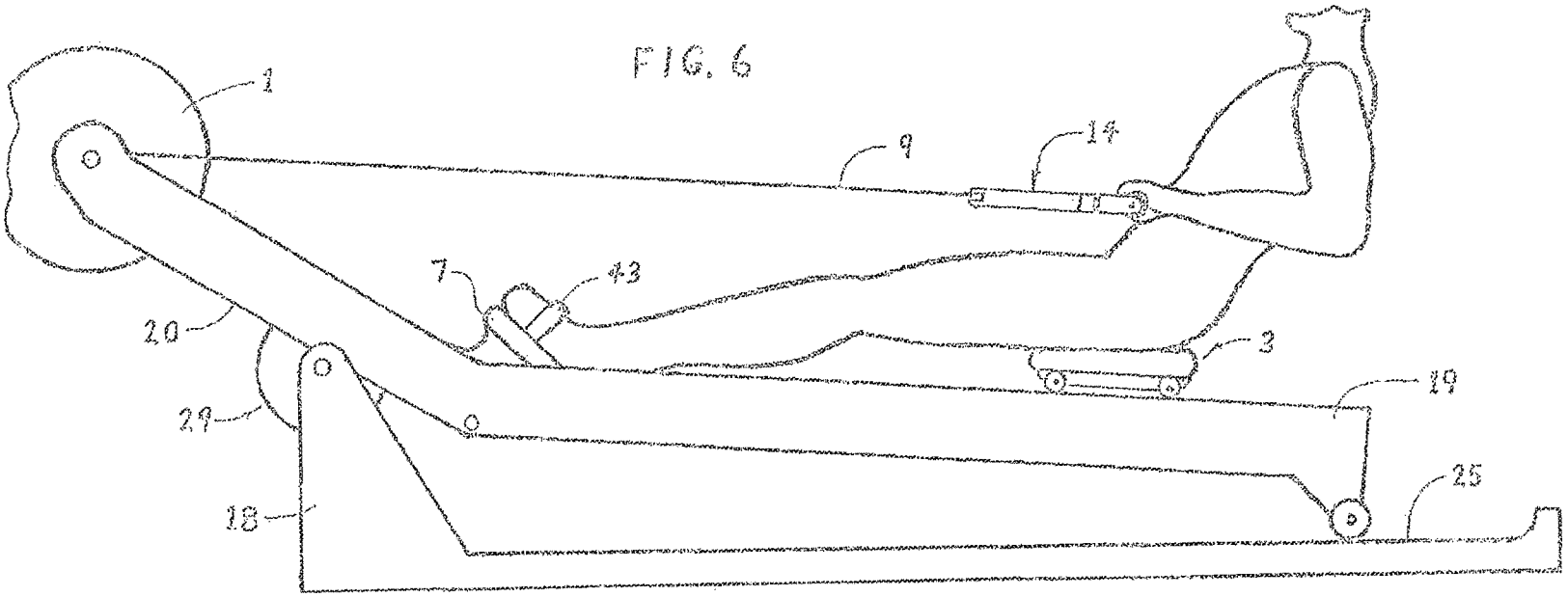
FIG. 6 is a side view of the FIG. 5 embodiment which depicts the position of the device and of the user on the device at the completion of the rowing stroke.

Referring to FIGS. 5 and 6, typically, on rowing exercise devices, the user's feet are secured to the footrests 7 by straps 43 or other means. On the return stroke, as the user slides forward on seat 3, the user pulls with the feet on the foot straps 43 to effect that movement. This pulling force on the straps 43 is imparted to the moveable frame 19, thereby assisting the force of gravity in pulling frame 19 down the front sloped tracks 20 and along rear horizontal tracks 25. Therefore, regardless of the user's weight, during the recovery portion of the rowing stroke, the force imparted by the user's leg movement through the foot straps 43 assists in taking up the slack of chain 9 and returning the handle 14 to the start position.

In certain disclosed embodiments, in addition to the user's weight, the static handle return force can be affected by certain structural elements of the rowing exercise device. As follows: The weight of that portion of the device being lifted; the diameter of the chain drum 30; the diameter of the strap drums 32; the diameter of spur gears 44; the gradient of front sloped tracks 20; the gradient of rear sloped tracks 72 and 74.

General quantitative parameters for these elements are: chain drum 30, 9" to 12" diameter; strap drum 32 (or spur gear 44), 1" to 2" in diameter; sloped tracks 20 and 72, 10° to 90°, preferably 15° to 45°, and more preferably 15° to 25° from the horizontal. However, other embodiments within the scope of the invention could have elements which do not conform to these quantitative guidelines. For example, chain drum 30 and strap drum 32 could conceivably be sized to pull the moveable frame up a very steep gradient, up to and including a perpendicular lift; or they could be sized to pull the moveable frame up a gradient of less than 15°. However, at gradients less than 10° there arises the practical consideration of the length of the sloped tracks 20 and 72 that would be required in order to lift the moveable frame and user through a vertical distance that would provide sufficient chain take-up and handle return force.

If any one or more of these structural elements were adjustable by the user, this would provide a means to adjust the static handle return force to the user's preference, or to ensure equivalence of static handle return force between different devices used in competitions, regardless of differences in competitor's weights.

Means are disclosed hereinafter to add or remove weight from the portion of the device being lifted. Means are also disclosed to adjust the rear sloped tracks 74. The strap drums 32 are also viable candidates for adjustability. For example, if the lengths of the left and right straps 39 wrapped on the left and right strap drums 32 at the beginning of the stroke were changeable by the user, this would alter the effective diameter of the strap drums 32, changing the mechanical advantage and therefore also changing the return force on the handle 14. This user adjustment would be enabled if the strap drums 32 incorporated releasable ratchet mechanisms (similar to well-known cargo strap tighteners).

Although in the disclosed embodiments the chain 9 is the primary force transmitting component, other means, such as a flat toothed drive belt or any of various profiled flat drive belts could viably replace the chain 9. Integral to any such choice would be a drum of similar design to the chain drum 9, but dimensioned to accommodate the alternative flat drive belt.

Figure 18:
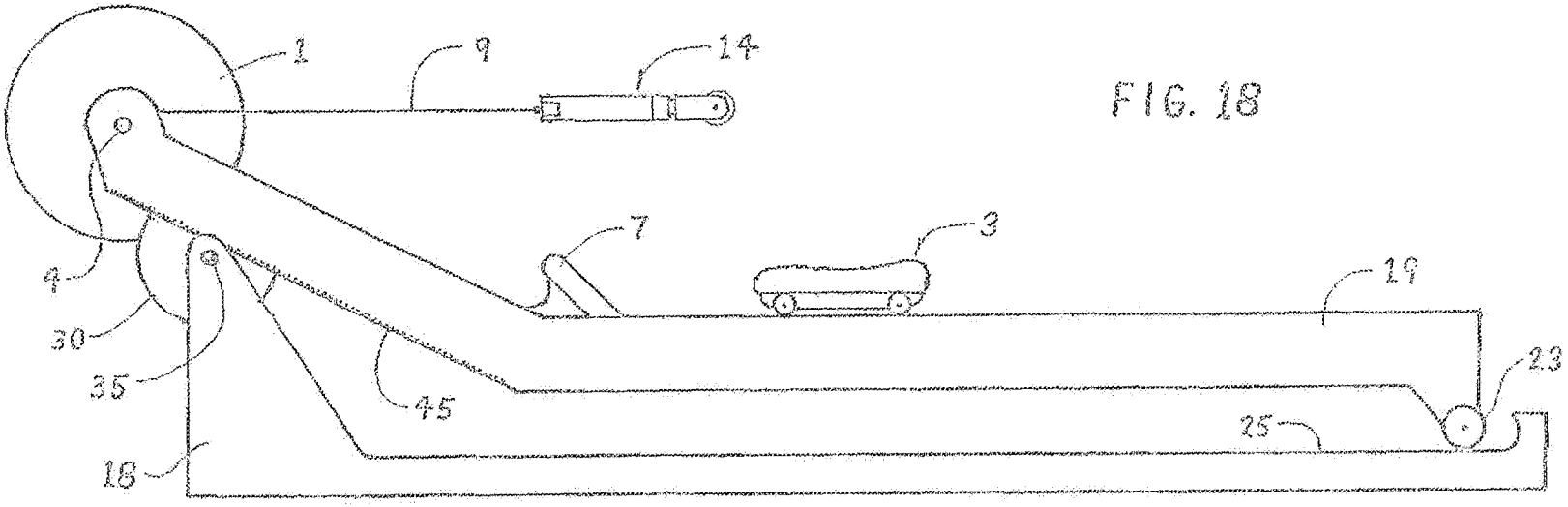
FIG. 18 is a side view of a fourth embodiment of the rowing exercise device of the present invention.
Figure 19:
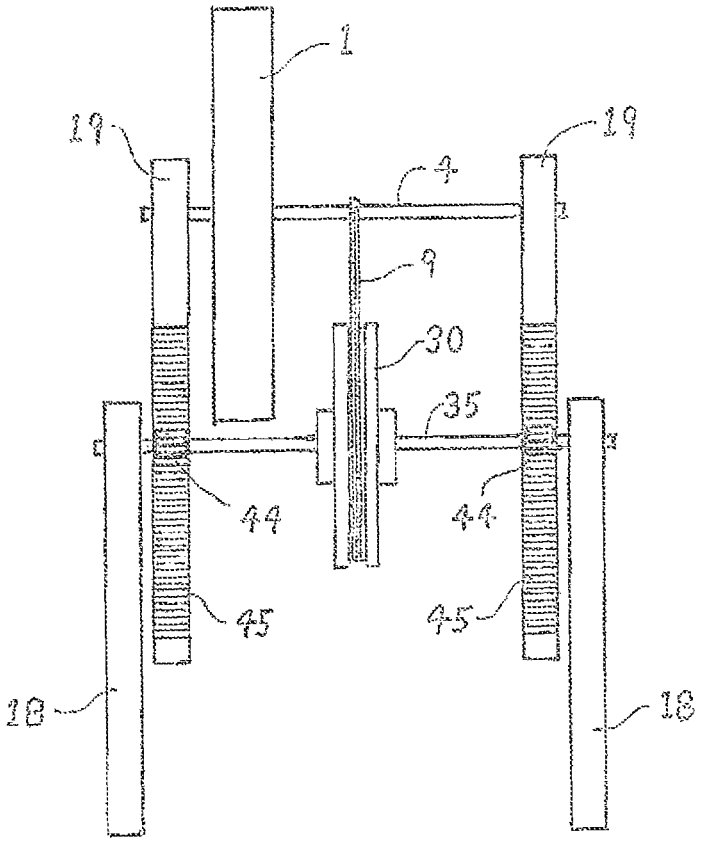
FIG. 19 is a front view of the FIG. 18 embodiment.

FIGS. 18 and 19 are side and front views, respectively, of a fourth embodiment of the rowing exercise device of the present invention. For clarity, the front view (FIG. 19) has excluded details rearward of the footrests 7 which would otherwise be visible. In this embodiment, left and right gears 44, e.g. spur, pinion or circular gears, and the left and right sloped gear racks 45 have replaced the hereinbefore described left and right strap drums 32, the left and right straps 39, the left and right sloped tracks 20, and the left and right wheels 42 in the force transfer assembly. The gears 44 are fixed to the shaft 35 and engage the racks 45.

Pulling on the handle 14 causes the chain 9 to unwrap from the chain drum 30, rotating the chain drum 30 together with the left and right gears 44, the teeth of which are meshed with the teeth of the left and right sloped gear racks 45, respectively. This causes the moveable frame 19 to be pulled up at the front and forward at the back, as hereinbefore described.

Returning the handle 14 causes the force of gravity to pull moveable frame 19 down at the front and to move rearward at the back. The resulting linear movement of the left and right sloped gear racks 45 relative to the left and right gears 44 causes the gears to rotate together with the chain drum 30. This rotation wraps the chain 9 onto the chain drum 30, taking up the slack of the chain 9, and assisting in the return of the handle 14.

Figure 20:
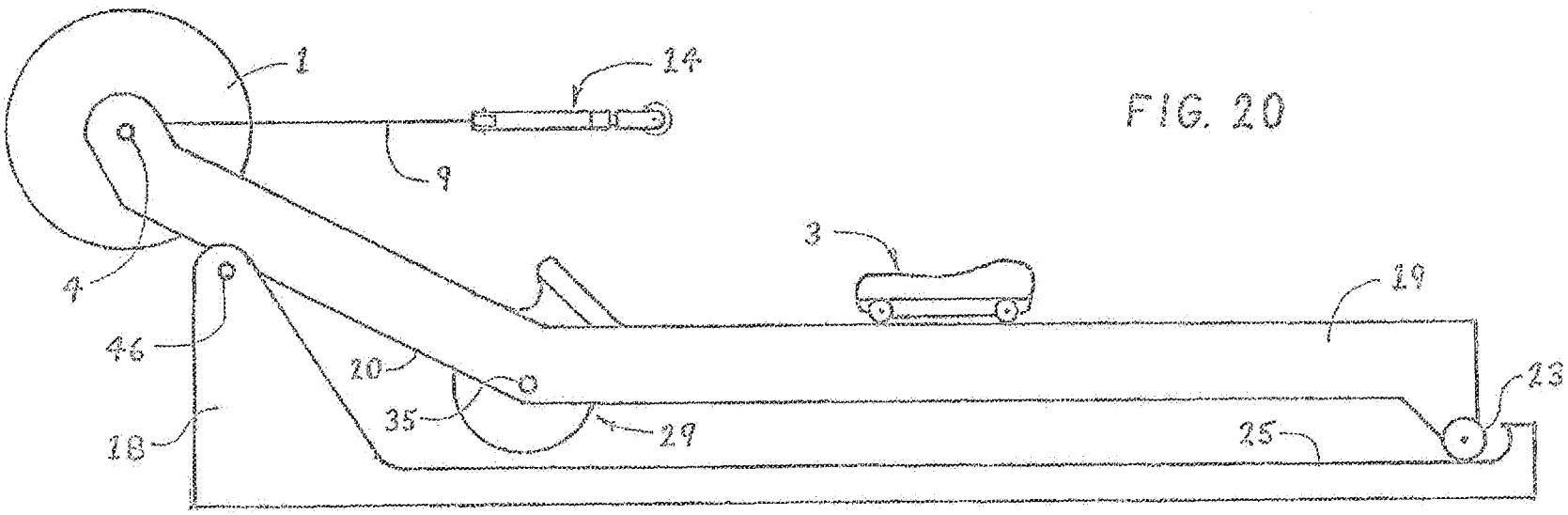
FIG. 20 is a side view of a fifth embodiment of the rowing exercise device of the present invention.
Figure 21:
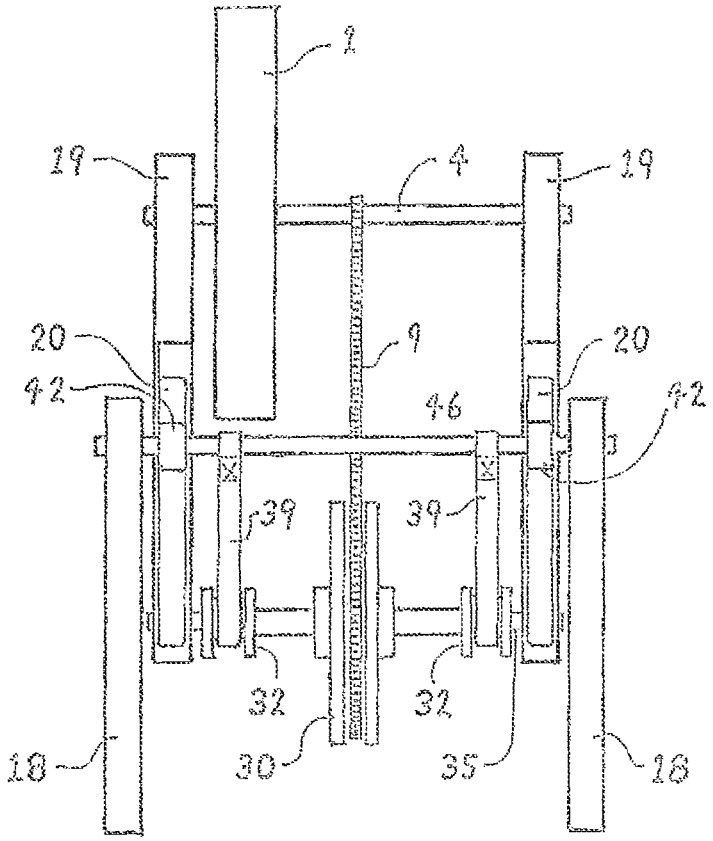
FIG. 21 is a front view of the FIG. 20 embodiment.

FIGS. 20 and 21 are side and front views of a fifth embodiment of the rowing exercise device. For clarity, the front view (FIG. 21) excludes details rearward of the footrests 7 which would otherwise be visible. In this embodiment, the shaft 35, which carries the chain drum 30, and the left and right strap drums 32, instead of being mounted in an elevated position at the front of stationary base 18, is rotatably mounted in a lower transverse position on the moveable frame 19.

The left and right straps 39 extend from the left and right strap drums 32, respectively, and are terminated at their other ends to a shaft 46, which is transversely and non-rotatably mounted in an elevated position at the front of stationary base 18. The left and right wheels 42 are rotatably mounted on the shaft 46. The left and right sloped tracks 20, integral to the front of moveable frame 19, bear on the wheels 42.

As hereinbefore described, pulling on the handle 14 causes the rotation of chain drum 30 together with strap drums 32, which causes the take-up of straps 39, thereby pulling moveable frame 19 up sloped tracks 20. Returning the handle 14 to the retracted rest position causes the force of gravity to pull the moveable frame 19 back down the sloped tracks 20, thereby pulling the straps 39 which causes the rotation of the strap drums 32 together with the chain drum 30, which takes up the slack of the chain 9 and assists in the return of the handle 14.

Figure 22:
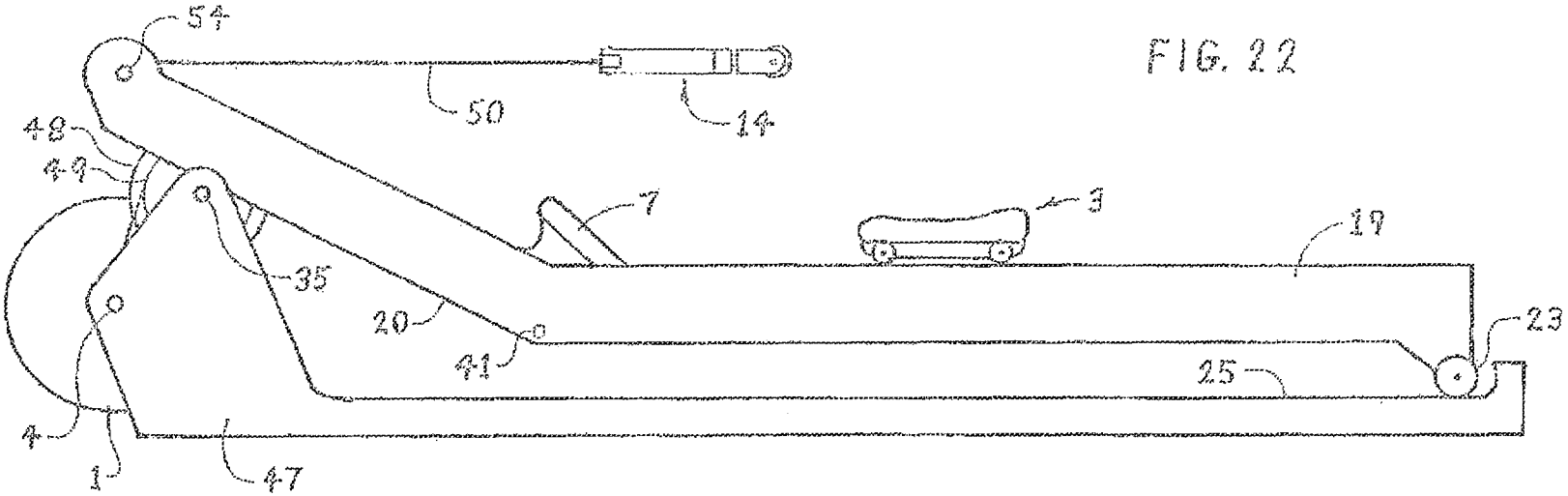
FIG. 22 is a side view of a sixth embodiment of the rowing exercise device of the present invention.
Figure 23:
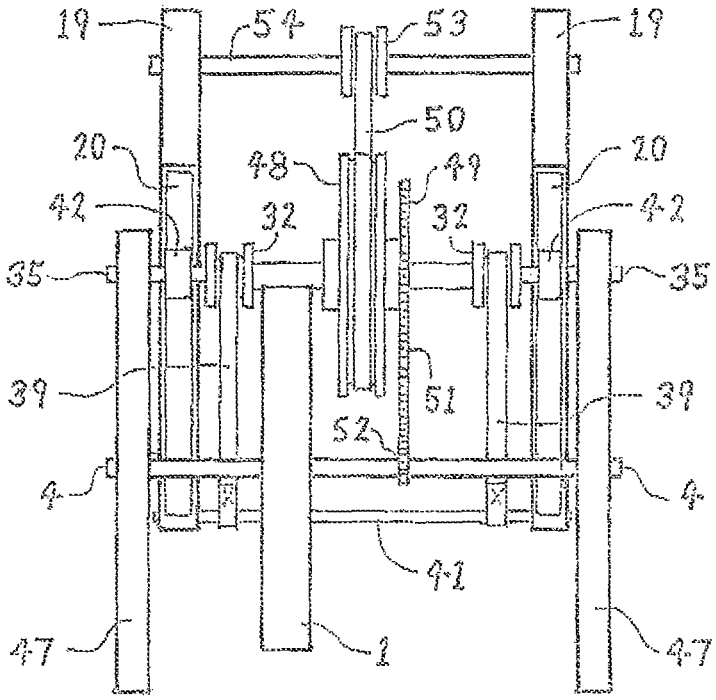
FIG. 23 is a front view of the FIG. 22 embodiment.

FIGS. 22 and 23 are side and front views of a sixth embodiment of the rowing exercise device of the present invention. For clarity, the front view (FIG. 23) excludes details rearward of footrests 7 which would otherwise be visible.

This embodiment is particularly suited to the utilization of a flat strap or belt connected between the handle 14 and the force transfer assembly, rather than the chain 9.

The flywheel 1 is still mounted on the shaft 4, but now the shaft 4 is rotatably mounted in a transverse position on a stationary base 47, similar to the base 18. A belt drum 48, a large sprocket or pulley 49, and the left and right strap drums 32, are mounted on the shaft 35, which is rotatably mounted in a transverse position on the stationary base 47. The belt drum 48, except for being dimensioned to accommodate the chosen size of the flat belt 50, is identical to the chain drum 30 utilized in other embodiments. The straps 39 extend from the strap drums 32 and are terminated at their other ends at the bar 41, which is fixed transversely in a lower front location on the moveable frame 19. A chain or belt 51 couples the large sprocket or pulley 49 on the shaft 35 to a small sprocket or pulley 52, which is fixably mounted on the flywheel shaft 4.

Pulling on the handle 14 causes the flat belt 50 to be pulled around the belt pulley 53 on a shaft 54, rotatably mounted on the moveable frame 19, and to unwrap the belt 50 from the belt drum 48, causing the rotation of the belt drum 48 together with rotation of the large sprocket or pulley 49 and rotation of the strap drums 32. Since the large sprocket or pulley 49 is coupled to the small sprocket or pulley 52 by the chain or belt 51, the rotation of the large sprocket or pulley 49 causes the flywheel 1 to rotate with the shaft 4. Simultaneously, the straps 39 wrap upon the strap drums 32, pulling the moveable frame 19 up the sloped tracks 20 on the wheels 42.

Returning the handle 14 to the retracted rest position causes the force of gravity to pull the moveable frame 19 back down the sloped tracks 20, which unwraps the straps 39 from the strap drums 32, causing the strap drums 32 and the belt drum 48 to rotate together, thereby taking up the slack of the flat belt 50 and assisting in the return of the handle 14. As in other embodiments, during the return portion of the stroke, a uni-directional clutch in the hub of the flywheel 1 disengages to allow the flywheel 1 to continue to rotate.

FIGS. 24 and 26 illustrate seventh and eighth embodiments, respectively, of the rowing exercise device of the present invention which share a particular structural element. In the sixth embodiment of FIG. 24, a moveable frame 55 is pivotally connected at the rear end of the device to a stationary base 56. In the seventh embodiment of FIG. 26, a moveable frame 57 is pivotally connected at the rear end of the device to a stationary base 58.

In the seventh embodiment of FIG. 24, the stationary base 56 has a raised horizontal section at the front end, relative to a lower horizontal section at the rear end, with a vertical or angled support therebetween. Left and right horizontal parallel tracks 59 are mounted along each side, respectively, at the top of the raised section of the base 56.

FIG. 25 depicts a modified force transfer assembly 29, comprised of the chain drum 30, the metal tube 31, the strap drums 32, and the shaft 35. To the modified assembly a pair of inner wheels 42, and a pair of outer wheels 60 have been rotatably mounted on shaft 35.

Referring to FIG. 24, the force transfer assembly 29 is located such that outer wheels 60 bear on the raised tracks 59, and the front sloped tracks 20 of moveable frame 55 bear on a respective one of the inner wheels 42.

Pulling on the handle 14 causes the chain 9 to be pulled from the chain drum 30, thereby rotating the chain drum 30 together with the strap drums 32, causing the straps 39 to be taken up by the strap drums 32. Since the second end of each strap 39 is terminated at the bar 41, which is transversely fixed in a low position on the moveable frame 55 (bar 41 is concealed in this depiction by a section of stationary base 56), the assembly 29 is pulled rearward along the raised tracks 59 on the outer wheels 60.

The resulting vertical component of force, as the inner wheels 42 bear against the sloped tracks 20, causes the moveable frame 55 to rise at the front end thereof and pivot on shaft 61 at the back end of the stationary base 56. The rearward movement of the force transfer assembly 29 together with the wheels 42 and 60, and the attendant rise of the moveable frame 55, is limited by left and right stops 62 integral to the rearward ends of the raised tracks 59.

Returning the handle 14, causes, under the force of gravity, the reverse of the described movements. The moveable frame 55 pivots at the back on the shaft 61, and as it descends at the front, the horizontal component of force imparted through the sloped tracks 20 to the inner wheels 42 mounted on the shaft 35 of the force transfer assembly 29, causes the force transfer assembly 29 to roll forward on the outer wheels 60 along the raised tracks 59, which results in the straps 39 unwrapping from the strap drums 32, thereby causing the strap drums 32 and the chain drum 30 to rotate together, taking up the slack of the chain 9 and assisting in the return of the handle 14. The forward movement of the force transfer assembly 29 together with the wheels 42 and 60, and the attendant descent of the front of the moveable frame 55, is limited by left and right stops 63 provided at the forward ends of the raised tracks 59.

In the eighth embodiment illustrated in FIG. 26, the shaft 35 of the force transfer assembly 29 is rotatably mounted in a fixed transverse position at the top of a moveable (sliding) carriage 64. Left and right sloped tracks 20, provided on the moveable (pivoting) frame 57, bear on the left and right wheels 42, which are rotatably mounted on the shaft 35. Two pairs of wheels 65 and 66 are rotatably mounted on shafts 67 and 68 respectively, which are transversely rotatably mounted to the base of the moveable carriage 64. The wheels 65 and 66 bear and roll upon left and right parallel tracks 69 provided on the front section of stationary base 58.

Pulling on the handle 14 causes the chain 9 to be pulled from the chain drum 30, thereby rotating the chain drum 30 together with the strap drums 32, causing the straps 39 to be taken up on the strap drums 32. Since the second end of each strap 39 is terminated at the bar 41, which is transversely fixed in a low position on the moveable frame 57, the moveable carriage 64 is pulled rearward along the tracks 69.

The resulting vertical component of force, as the wheels 42 bear against the sloped tracks 20, causes the moveable frame 57 to rise at the front and pivot on the shaft 61, which pivotally connects the moveable frame 57 to the base 58, at the rear end thereof. The rearward movement of the moveable carriage 64 and the attendant front rise of the moveable frame 57 is limited by left and right stops 70 integral to the bottom of the moveable frame 57 at the bottom ends of the sloped tracks 20.

Returning the handle 14 causes, by the force of gravity, the reverse of the described movements. The moveable frame 57 pivots downwardly about the shaft 61, and as it descends at the front, the horizontal component of force imparted through the sloped tracks 20 to the wheels 42 on the moveable carriage 64 causes the moveable carriage 64 to move forward along the tracks 69 which results in the straps 39 unwrapping from the strap drums 32 causing the strap drums 32 and the chain drum 30 to rotate together, thereby taking up the slack of the chain 9 and assisting in the return of the handle 14. The forward movement of the moveable carriage 64 and attendant descent of the front of the moveable frame 57 is limited by left and right stops 71 integral to the bottom of the moveable frame 57 at the top end of the sloped tracks 20.

The seventh and eight embodiments, illustrated in FIGS. 24 and 26 are perhaps less preferred than certain other embodiments because under dynamic conditions, the pull of the user's feet against the foot straps 43 during the return (recovery) portion of the stroke will impart no rearward movement to either the moveable frame 55/57, and therefore this force on the foot straps 43 will not assist in the return of the handle 14 as it does with certain other disclosed embodiments.

Figure 27:
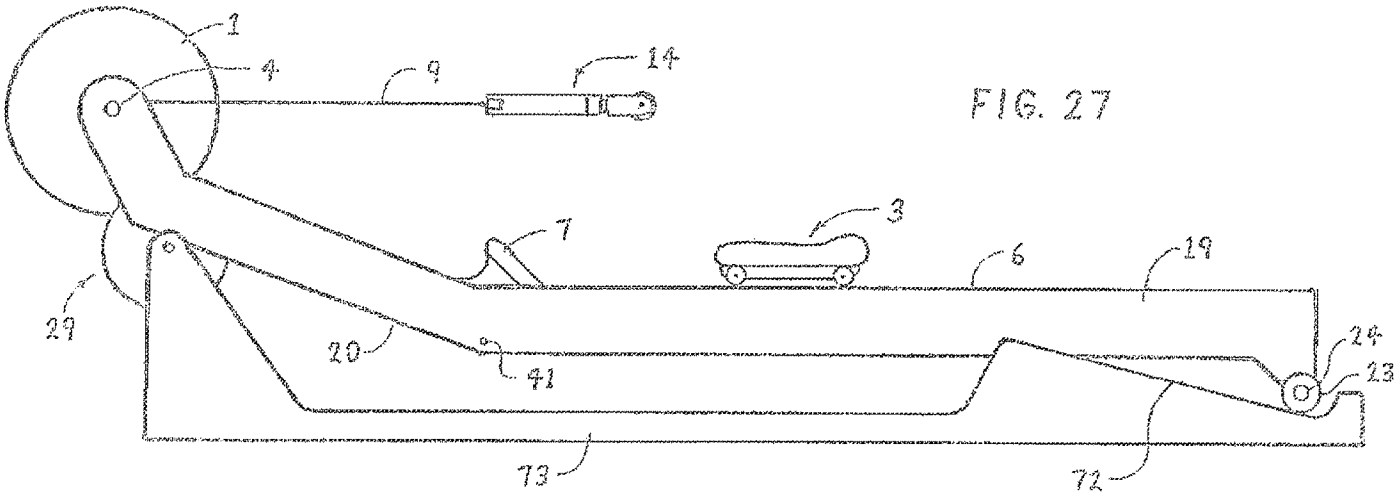
FIG. 27 is a side view of a ninth embodiment of the rowing exercise device of the present invention.

FIG. 27 is a side view of a ninth embodiment of the rowing exercise device of the present invention. This embodiment, in addition to the front sloped tracks 20 integral to the underside of the moveable frame 19, incorporates a second pair of left and right sloped tracks 72 at the rear of a stationary base 73.

Pulling on the handle 14 causes the chain drum 30 to rotate together with the strap drums 32 as hereinbefore described, which causes the moveable frame 19 to simultaneously roll forward and up the front sloped tracks 20 and the rear sloped tracks 72 on the front wheels 42 and on the rear wheels 23, respectively. Returning the handle 14 causes a reverse of this movement and attendant gravity driven take-up of the chain 9 as hereinbefore described.

Since both the front and rear of the moveable frame 19 are simultaneously being moved through a vertical distance during the power and return portions of the rowing stroke, if the gradient, i.e. acute angle from the horizontal, of the front sloped tracks 20 and rear sloped tracks 72 are identical, seat rail 6 will remain level throughout all phases of the rowing stroke. If the gradient, i.e. acute angle from horizontal, of the rear sloped tracks 72 is less than the gradient of the front sloped tracks 20, moveable frame 19 will rise more at the front than at the rear during the power portion of the rowing stroke and the seat rail 6 would assume a slightly downward pitch front to back. By some users this could be considered desirable since it simulates the action of an actual boat in the water as the rower's weight shifts fore and aft during the rowing stroke. Any combination of front and rear slope gradients is viable provided the front and rear slope gradients, in combination with the other mechanical elements, result in a handle return force sufficient to briskly take up chain 9. FIG. 27 embodiment would be identical to FIG. 7 embodiment if the rear sloped track 72 were reduced to 0° from the horizontal.

Figure 28:
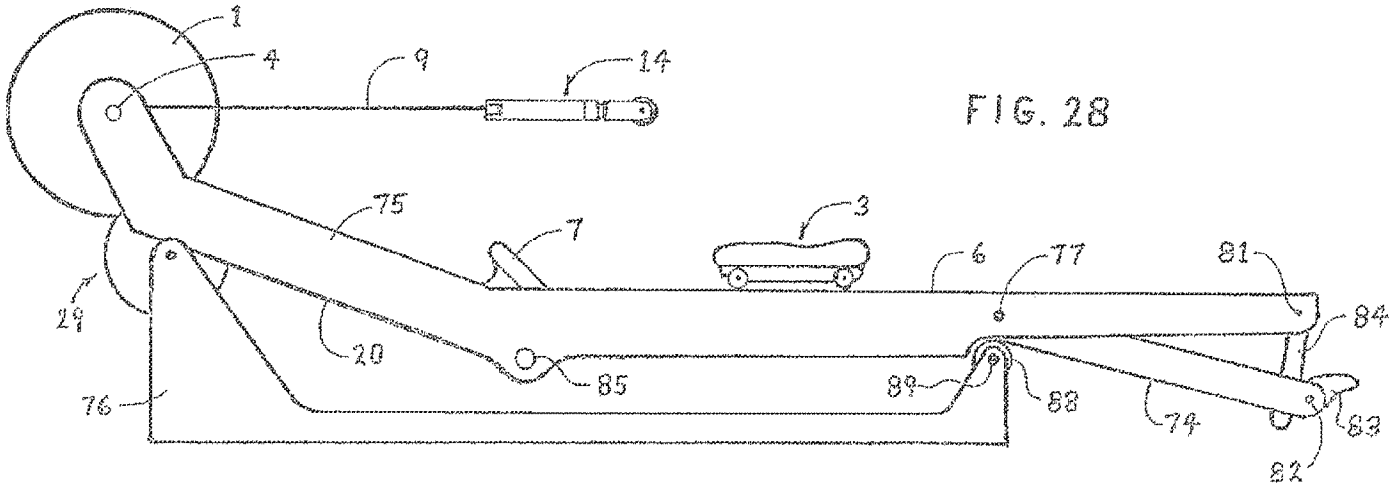
FIG. 28 is a side view of a tenth embodiment of the rowing exercise device in accordance with the present invention that enables user adjustment of the chain take-up and handle return force.

FIG. 28 is a side view of a tenth embodiment of the rowing exercise device of the present invention, which is functionally identical and structurally similar to the embodiment depicted in FIG. 27 in that it also incorporates a pair of left and right adjustable sloped surfaces or tracks 74 at the rear of the device. The difference between the embodiments is that the rear sloped surfaces 74 in this embodiment are part of a moveable frame 75 rather than a stationary base 76, and the gradient of the adjustable rear sloped surfaces 74 is adjustable.

Various means can be utilized to adjust the gradient of the adjustable rear sloped surfaces 74. FIG. 33 is a perspective view that depicts the rear assembly of the moveable frame 75, the left and right adjustable surfaces 74, and the adjustable track gradient elements 81 to 84 utilized in the presently described FIG. 28 embodiment, and also utilized in the later described embodiment depicted in FIG. 31 and FIG. 32. Note that some elements illustrated in the FIG. 33 perspective view differ from those in the FIG. 28 embodiment. In the FIG. 28 embodiment, a shaft 89 carries only the inner pair of wheels 88, on which the left and right sloped tracks 74 bear; and a shaft 89 is transversely pivotally mounted in a low raised section at the rear of the stationary base 76 rather than transversely pivotally mounted at the rear of a moveable carriage 104, as depicted in FIG. 33. These differences are unrelated to, and do not affect, the adjustable surfaces 74 described herein and common to FIG. 28 and FIG. 31 embodiments.

Referring to FIG. 33, the left and right adjustable sloped surfaces 74 are pivotally connected near their inner ends to left and right sides of the moveable frame 75, respectively, by pins 77. Left and right stops 78 are integral to the ends of the surfaces 74 to limit the rearward movement of the moveable frame 75. The stops 78 could be augmented or replaced with stops integral to the front sloped tracks 20 as depicted on certain other disclosed embodiments.

The rearward ends of the left and right seat rails 6 formed in or on the left and right sides of the moveable frame 75, and the rearward ends of left and right tracks 74, are strengthened and stabilized by transverse support members 79 and 80, respectively, through which pass transverse rotating shafts 81 and 82, respectively. Transverse support members 79 and 80 are both notched in the middle to provide space to pivotally mount a cam lever 83 on the shaft 82 and to pivotally mount a cam clamping plate 84 on the shaft 81.

Adjustment of the gradient of the surfaces 74 is effected by the manual rotation of the cam lever 83 to release the pressure on the cam plate 84. The surfaces 74 can then be manually pivoted up or down on the pins 77 to one of a plurality of angular positions defined by a series of cam engaging structures, e.g. teeth, holes etc., on the cam plate 84. Then the cam lever 83 can be manually rotated so that a cam portion thereof is engaged with the cam engaging structures on the cam plate 84 to reapply pressure onto the cam plate 84, thereby locking the tracks 74 at the new chosen location and gradient. The geometry of the cam portion of cam lever 83 is such that the weight of moveable frame 75 and the weight of the user on the device will tend to rotate the cam lever 83 in the direction of increased clamping pressure, thereby ensuring that the selected gradient of surfaces 74 will be maintained.

The return force imparted by the chain 9 to the handle 14 is directly proportional to the steepness of the gradient of the front sloped tracks 20 and/or the rear sloped tracks 74. Therefore incorporating adjustment means to the gradient of the rear surfaces 74 enables the user to adjust the handle return force to the user's preference. It also provides a means to equalize the handle return force between different rowing exercise devices used in competitions, regardless of the weights of the various competitors. It also enables the user to choose to what degree, if any, the seat rail 6 gradient will change throughout the stroke.

The tenth embodiment of FIG. 28, also illustrates a second means to enable user adjustment of the handle return force. Left and right pegs 85 centrally mounted on moveable frame 75 are sized to accept standard barbell plates. The addition or removal of barbell weight plates from the pegs 85 would increase or decrease the return force on the handle 14. The pegs 85, and therefore the second means to adjust the handle return force can also be provided on any of the previous or subsequent embodiments.

Figure 30:
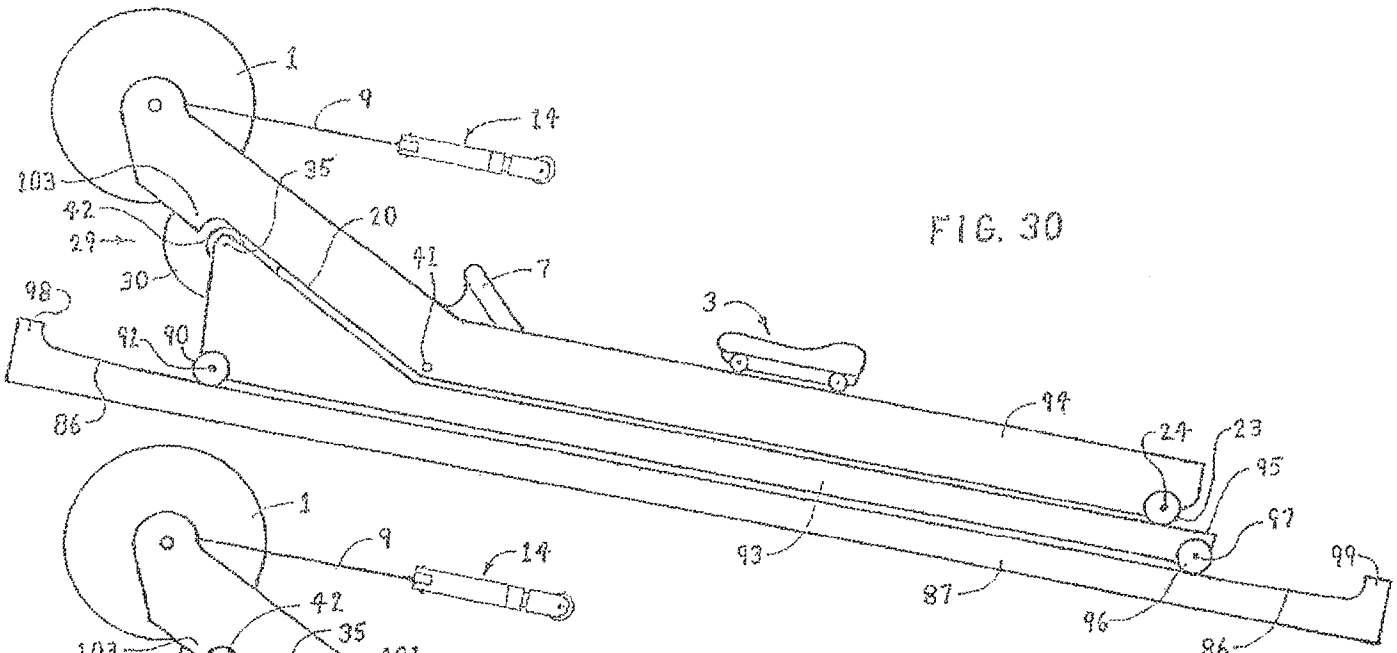
FIG. 30 is a side view of a twelfth embodiment of the rowing exercise device of the present invention that is dynamically balanced.
Figure 29:
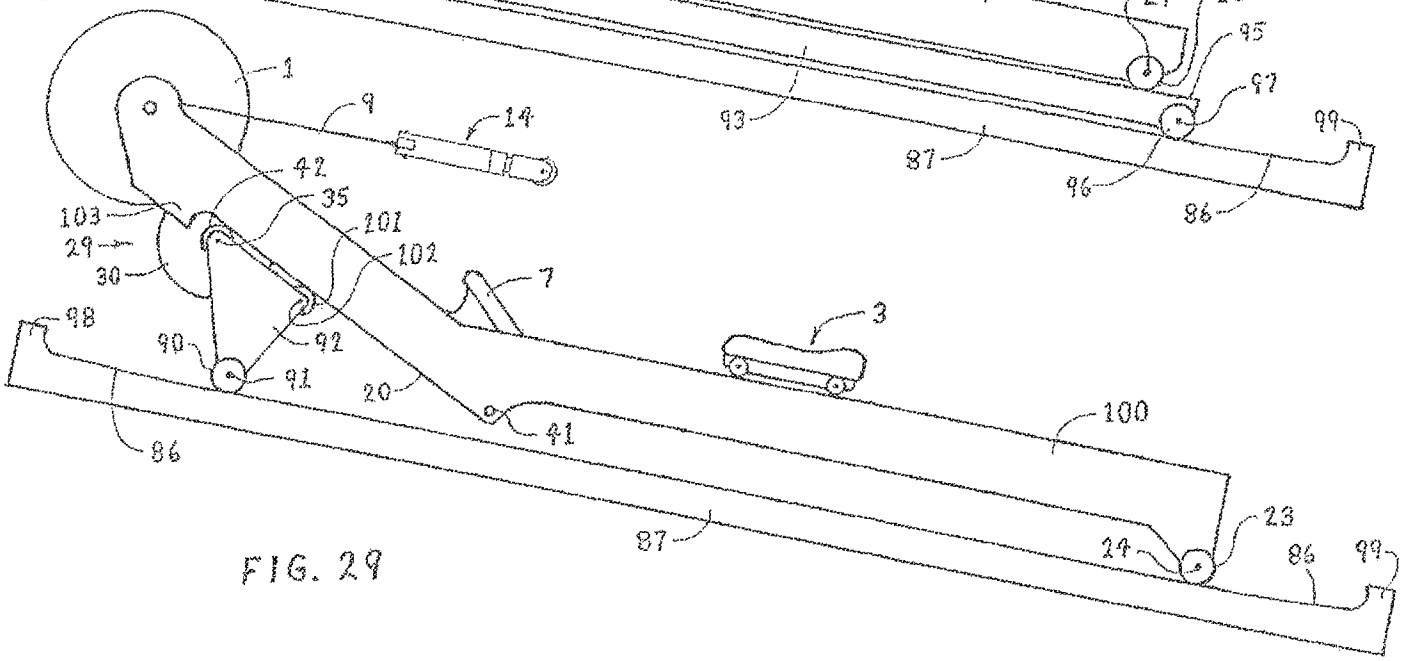
FIG. 29 is a side view of an eleventh embodiment of the rowing exercise device of the present invention that is dynamically balanced.

FIGS. 29 and 30 illustrate side views of eleventh and twelfth embodiments, respectively, of the rowing exercise device of the present invention. Both of these embodiments exhibit, in the same manner, functional differences from the preceding described embodiments. Their functional characteristics are similar to those of the rowing exercise device disclosed in U.S. Pat. No. 5,382,210 by Rekers ("Dynamically Balanced Rowing Simulator"), but achieved by simpler means. "The series of pulleys and an elastic element" integral and necessary for the proper functioning of the Rekers device, have, in the FIGS. 29 and 30 embodiments been eliminated and replaced with the simple gravity driven handle return means of certain preceding and hereinbefore described embodiments.

In both the FIGS. 29 and 30 embodiments, a moveable carriage 92/93 has been interspersed between a stationary base 87 and a moveable frame 100/94. The illustrated structural differences between the two moveable carriages 92/93 result in no functional differences between the FIG. 29 and FIG. 30 embodiments.

In both embodiments, the moveable carriage 92/93 and the moveable frame 94/100 are free to roll as units forward and rearward along left and right tracks 86 common to both embodiments and provided in or on the stationary base 87.

In the FIG. 29 embodiment, the described free rolling movement is facilitated by left and right wheels 90 rotatably mounted on a transverse shaft 91 located and rotatably mounted at the bottom of the moveable carriage 92, and by the left and right wheels 23 rotatably mounted on the transverse shaft 24 at the rear end of the moveable frame 100. The wheels 23 bear and roll on left and right tracks 86 provided in or on the stationary base 87. The moveable carriage 92 is ideally comprised of a pair of triangular side frames with transverse cross braces extending therebetween along with the assembly 29, as hereinbefore described.

In the FIG. 30 embodiment, the described free rolling movement is facilitated by the left and right wheels 90 rotatably mounted on the transverse shaft 91 located at the lower front of a moveable carriage 93, but in this embodiment, moveable carriage 93 extends lengthwise to the rear end of the moveable frame 94, and as a result of this structure, left and right rear wheels 23 rotatably mounted on transverse shaft 24 at the rear of moveable frame 94, bear on left and right tracks 95 provided in or on the top edges of moveable carriage 93, and left and right wheels 96 rotatably mounted on a transverse shaft 97 at the rear of the moveable carriage 93, bear on left and right tracks 86 provided in or on the stationary base 87 at the rear end thereof.

The free forward and rearward rolling movement of the described and illustrated assemblies is limited fore and aft by left and right front stops 98 and left and right rear stops 99 extending from the stationary base 87. Ideally, the left and right tracks 86 also have a slight upward rise of approximately ½" to 2", ideally 1", in the 12" adjacent to the front and rear stops 98 and 99 to gradually slow movement of the moveable carriages 92/93 and moveable frames 100/94.

Referring to FIG. 29 and considered in isolation from user leg movement, applying a force by pulling on the handle 14 in the rearward direction causes the chain drum 30 to rotate together with the strap drums 32, as hereinbefore described, which causes the moveable frame 100 and the moveable carriage 92 to move in relation to each other. The moveable frame 100 is pulled forward on the rear wheels 23 along the tracks 86 and up the sloped tracks 20, which bear and roll upon the two pairs of left and right wheels 42 and 101 rotatably mounted on transverse shafts 35 and 102, respectively, and located at the top of the moveable carriage 92. Simultaneously, the moveable carriage 92 is pulled rearward along the tracks 86 on the left and right wheels 90.

In actual use, user leg movement occurs simultaneously with user pulling of the handle 14. If this leg movement is also considered, the forward applied force of the user's feet to the left and right footrests 7 cause the moveable frame 100 and the moveable carriage 92 to roll forward together on the tracks 86, even as the moveable carriage 92 is moving rearward relative to the moveable frame 100.

During the return of the handle 14, the described movement of the various elements is reversed, and the force of gravity on the elevated moveable frame 100/94, as hereinbefore described, takes up the slack of the chain 9 and assists in the return of the handle 14.

Left and right stops 103, extending from to the top end of the left and right sloped tracks 20 engage the wheels 42 and limit the descent of the front of the moveable frame 100 and 94 in both the FIG. 29 and FIG. 30 embodiments.

As noted above, the FIG. 30 embodiment is functionally identical to the FIG. 29 embodiment. During use, no difference between them would be experienced.

The final result of the described movements of the various elements is that throughout the power and return portions of the rowing stroke, the sliding seat 3 on which the user sits, remains almost stationary relative to the stationary base 87. This occurs because as the moveable carriage 92 and 93 and the moveable frame 94 and 100 move linearly forward and rearward in response to user application of force to the handle 14 and to footrests 7, the centre of gravity of these assemblies and of the user remains stationary, but since the assemblies typically have less mass than the user, greater linear movement is imparted to them.

The front and rear stops 98 and 99 limit the linear movement of the moveable carriages 92/93 on the tracks 86, but the wheels 90 and 23 in FIG. 29, and the wheels 90 and 96 in FIG. 30, would typically only contact those stops during the first two or three strokes when starting from rest. When the user's rowing rhythm is established the device is dynamically balanced, and the gradients at the ends of the tracks 86 cause the linear movement of the device to settle gravitationally into a defined range in which said wheels do not contact the front and rear stops 98 and 99.

Figure 32:
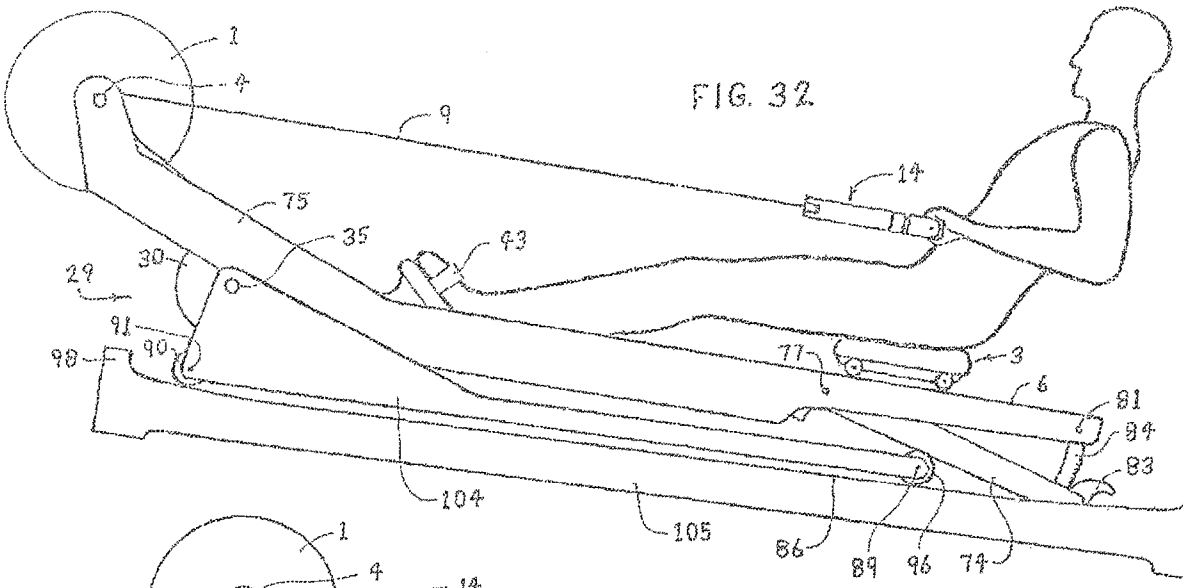
FIG. 32 depicts the position of the various elements of the FIG. 31 embodiment and of the user at the completion of the rowing stroke.
Figure 31:
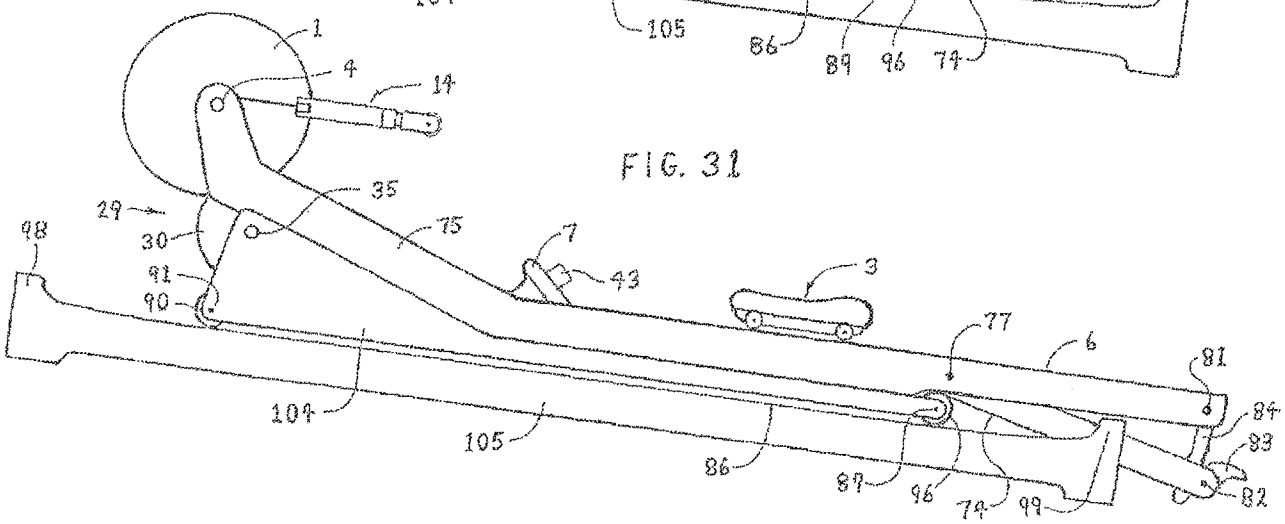
FIG. 31 is a side view of an thirteenth embodiment of the rowing exercise device of the present invention that is dynamically balanced and that enables user adjustment of the chain take-up and handle return force.
Figure 33:
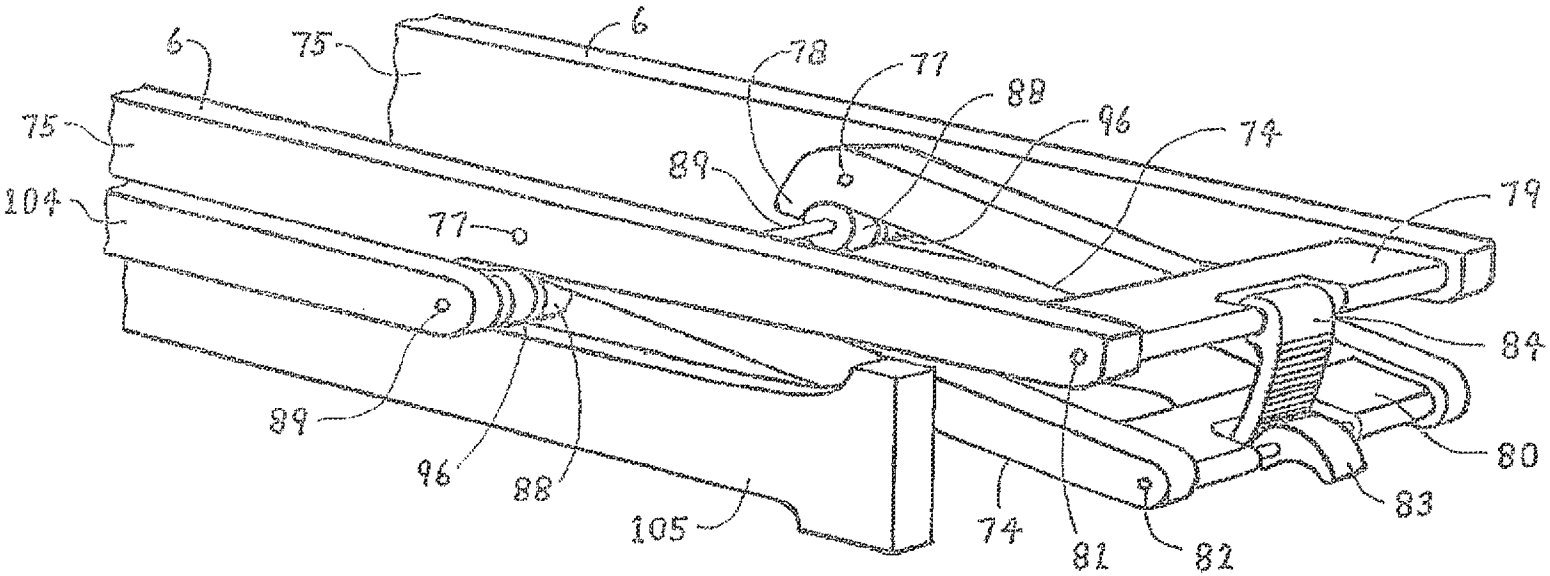
FIG. 33 is a perspective view of the rear adjustment mechanism of the FIG. 31 embodiment.

FIGS. 31 and 32 are side views of a thirteenth, and preferred, embodiment of the rowing exercise device of the present invention, which shares the dynamically balanced functionality and much of the structure of the FIG. 30 embodiment, but to that functionality and structure is added the adjustable rear sloped tracks 74 of the FIG. 28 embodiment.

FIG. 32 is a side view of the FIG. 31 embodiment which depicts the position of the device and its various elements, and the position of a user on the device, at the completion of a stroke with the handle 14 and the chain 9 in the fully extended use position.

FIG. 33 is a perspective view of the rear portion of the FIG. 31 embodiment depicting the structural details and the relationship between the moveable frame 75, the moveable carriage 104, the adjustable rear sloped surfaces or tracks 74, the stationary base 105, and the other elements. A description of these and the adjustment means for the rear sloped tracks 74 is included with the preceding description of the FIG. 28 embodiment.

A requirement of the dynamically balanced functionality of the thirteenth embodiment of FIGS. 31 and 32, which it shares with the eleventh and twelfth embodiments of FIGS. 29 and 30, respectively, is the ability to freely roll forward and rearward on the tracks 86. At the front of the device, this free rolling is facilitated by left and right wheels 90, which are rotatably mounted on shaft 91, which is rotatably mounted transversely in a lower front position of moveable carriage 104 (92 and 93). At the rear end of the device, this free rolling is facilitated by a second pair of left and right wheels 96, which are rotatably mounted on the shaft 89 to the outside of the left and right wheels 88 (visible in FIG. 33).

The wheels 96 bear on the rear portion of the tracks 86, which are provided in or on the stationary base 105. Note that to ensure that the described free rolling of the wheels 96 on the tracks 86 will not be impaired, the bottom edges of moveable frame 75, where they are in proximity to left and right wheels 96, are profiled to provide clearance for said wheels. The tracks 86, as described hereinbefore, with respect to FIG. 29 and FIG. 30 embodiments, have a slight upward gradient in the sections adjacent to left and right end stops 98 and 99 to gradually slow down the moveable carriage 104.

The dynamically balanced functionality of the FIG. 31 embodiment is identical to that described for the FIG. 30 embodiment. The addition of the rear adjustable sloped tracks 74, as with the FIG. 28 embodiment, enables the user to adjust the return force on the handle 14, either to the user's preference, or to ensure equivalence of the handle return force between rowing exercise devices used in competitions, regardless of variations in competitor's weights.

With respect to ensuring equivalence of the handle return force between devices used in competitions: A weight scale could be marked on the cam plate 84, calibrated such that when the tracks 74 are set at a gradient in which the weight indicator on the cam plate scale matched the weight of the user, the static return force on the handle 14 would be a constant value (For example: 7 pounds) regardless of the weight of the user.

Figure 34:
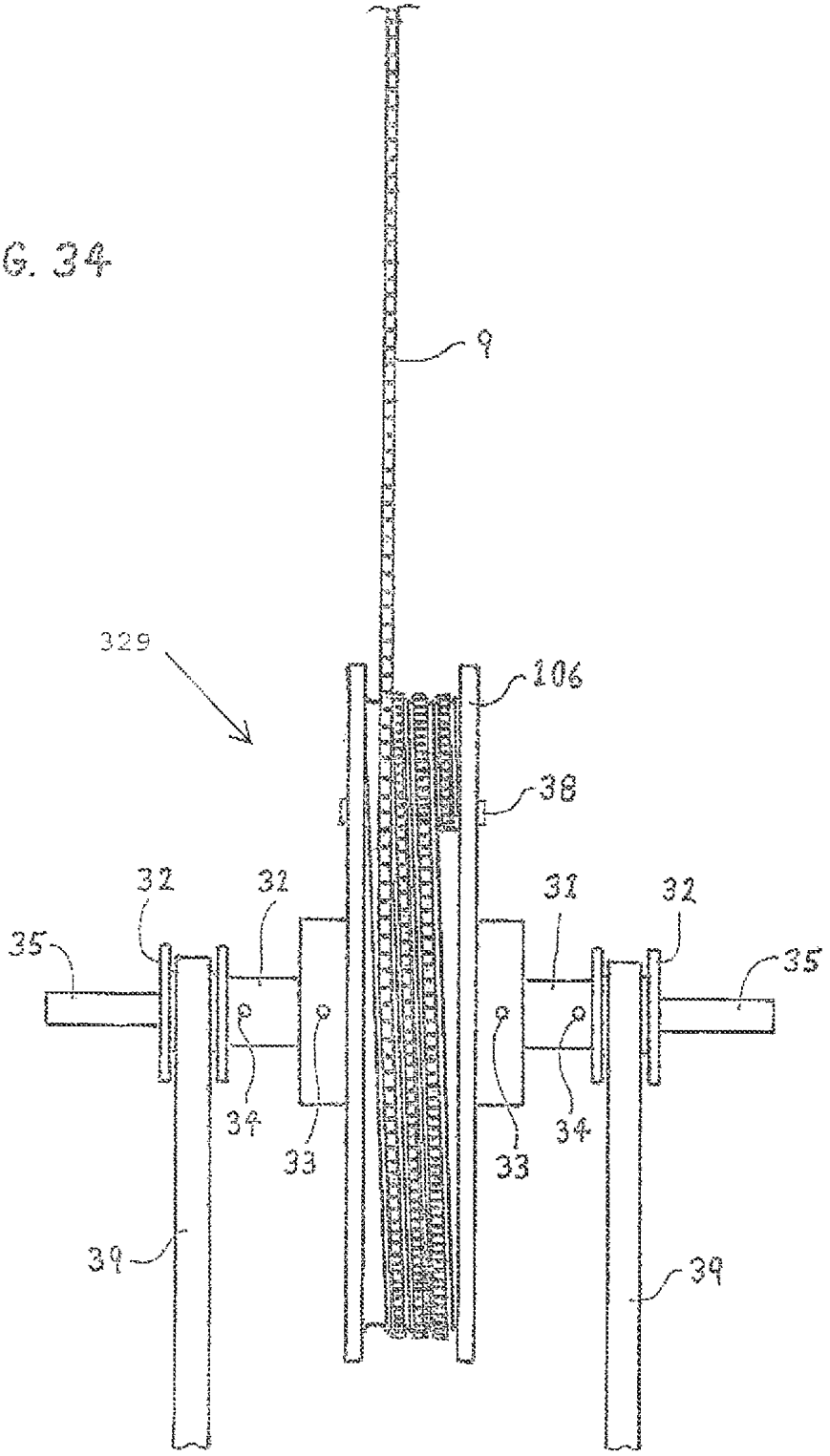
FIG. 34 depicts an alternative chain drum that incorporates a horizontal spiral groove on which to wrap the chain.

FIG. 34 depicts an alternative force transfer assembly 329 comprised of a chain drum 106, the left and right strap drums 32 with the metal tube 31, and the shaft 35, which could replace the force transfer assembly 29 in certain disclosed embodiments.

The chain drum 106 depicted in FIG. 34 incorporates a constant radius spiral groove on which to guide and wrap the chain 9, instead of spirally wrapping the chain 9 upon itself as is done with the chain drum 30 and depicted in FIG. 11.

To minimize chain skewing, the diameter of the chain drum 106 is sufficiently large (10"-12") to require only 2-3 rotations to take up and deliver the length of the chain 9 necessary for a typical rowing stroke.

In the illustrated assembly, the chain drum 106 and the left and right strap drums 32 are fixed to the steel tube 31 by left and right pins and set screws 33 and 34 respectively. Therefore, the chain drum 106 and the strap drums 32 will rotate together as a unit. One end of the chain 9 is connected to the chain drum 106 with the bolt 38, which is passed through the chain end fitting 37 depicted in FIGS. 12 and 13.

In reference to chain skewing, if the chain drum 106 were utilized, for example, in the rowing exercise device depicted in FIG. 20, the distance from the drum 106 to the sprocket 5 on the flywheel shaft 4 would be such that any skewing of the chain 9 that occurs would be less than the chain skewing that typically occurs with a derailleur bicycle transmission.

Figure 35:
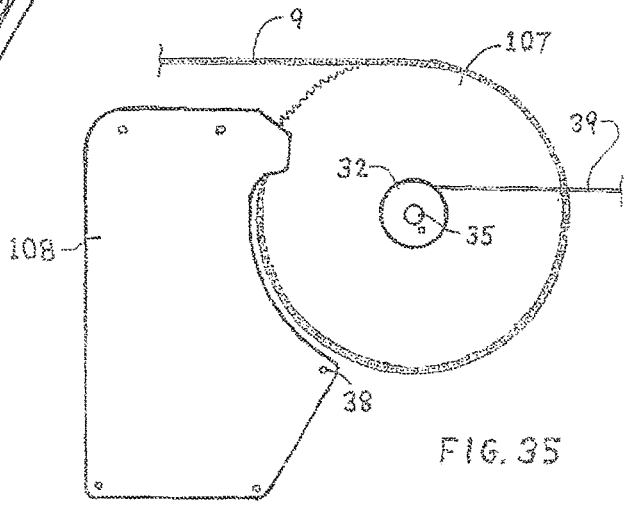
FIG. 35 is a side view of an alternative chain take-up and delivery mechanism.

FIG. 35 depicts another chain delivery and take-up system, whereby the chain 9 passes about a large sprocket 107 rotatably mounted in an opening in a chain canister 108, and is drawn forth and fed into the chain canister 108 during the power and return phases of the rowing stroke respectively. The sprocket 107 and the chain canister 108 assembly could replace the chain drum 30 or the chain drum 106 in certain disclosed embodiments.

Figure 36:
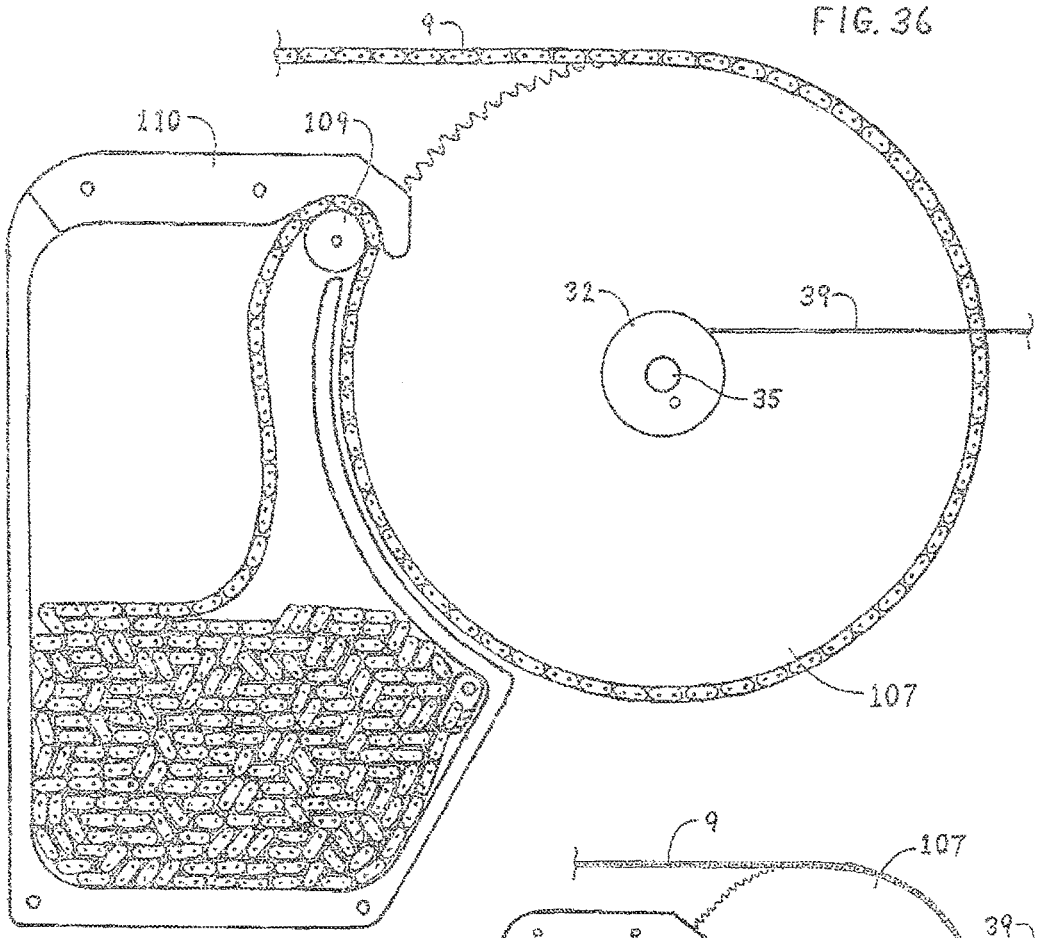
FIG. 36 depicts the interior of the FIG. 35 mechanism.

FIG. 36 depicts the interior details of the chain canister 108 and the chain sprocket 107 assembly. Pulling on the handle 14 places tension on the chain 9, causing the sprocket 107 to rotate and the chain 9 to be drawn forth through the opening and from the chain canister 108. As the chain 9 is drawn forth it is guided onto the sprocket 107 by the roller 109 and a chain guiding fork 110. The chain 9 is prevented from being drawn completely from the canister 108 by the bolt 38 through the chain end fitting 37, as hereinbefore described. The interior space of the chain canister 108 is dimensioned to allow a slip fit of the width of the chain 9, and is of a volume sufficient to accommodate the required length of the chain 9.

Figure 37:
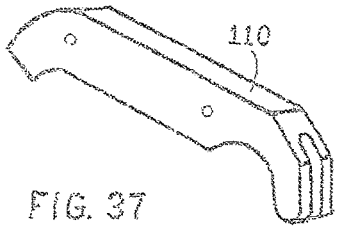
FIG. 37 is a perspective view of a chain guide component of the FIG. 35 mechanism.

FIG. 37 is a perspective view of the chain guiding fork 110, which includes a slotted curved tip that extends in a close tolerance fit over the toothed edge of the chain sprocket 107 to smoothly guide the chain 9 in and out of the chain canister 108. The chain guiding fork is fabricated from a strong, wear resistant, slippery material (Nylon for example).

As with previously described chain drum 30 and chain drum 106, the chain sprocket 107 rotates together with the left and right strap drum 32 on the shaft 35. If the chain canister 108 and the chain sprocket 107 were fitted to certain disclosed embodiments, returning the handle 14, would cause, by the force of gravity and hereinbefore described mechanics, the chain sprocket 107 to reverse rotation. This would take up the slack of the chain 9 and feed the chain 9 back into the chain canister 108, guided by the roller 109 and the chain guiding fork 110.

The disclosed rowing exercise device is generally symmetrical about a vertical plane extending lengthwise through the base (perpendicular to the transverse members at each end thereof). The two exceptions to this symmetry are: the flywheel 1 which is located on one side or the other of the lengthwise vertical plane; and the flywheel drive mechanism of an embodiment depicted in FIG. 22 and FIG. 23. For economy and clarity therefore, like reference numbers are used to designate both the "left-hand" and "right-hand" parts of the device.

In any disclosed embodiments that utilize wheels and tracks, registration between said wheels and tracks can be maintained either by the use of grooved tracks or by the use of flanged wheels.

I claim:

1. A rowing exercise device comprising:

a base comprising a raised front end extending upwardly from a lower horizontal rear end;

a moveable frame mounted on the base, the moveable frame including:

footrests for receiving a user's feet;

a user-supporting seat slideable relative to the base and the footrests;

an upwardly sloped front end slideable on the front end of the base, whereby the front end of the moveable frame moves upwardly relative to the base; and a rear section, horizontal in a rest position, for moving relative to the horizontal rear end of the base;

a rotational inertia device for providing resistance to the user during use rotatable about a first shaft;

a handle for grasping by the user connected on an end of a cable, wherein the cable engages the first shaft, for rotating the rotational inertia device upon application of a first rearwardly directed force by the user on the handle and a simultaneous application of a second forwardly directed force by the user on the footrests, wherein the handle and the cable are moveable away from the front end of the base between a retracted rest position and an extended use position upon application of the first and second forces by the user, thereby simulating rowing; and a force transfer assembly connected on another end of the cable for transferring the first force applied to the handle;

wherein the force transfer assembly is connected to the moveable frame, whereby pulling on the handle forces the front end of the moveable frame to slide upwardly relative to the base on the raised front end of the base, while the rear section of the moveable frame remains in contact with the horizontal rear end of the base; and wherein release of the first force on the handle results in the front end of the moveable frame to slide back down relative to the base under the force of gravity resulting in the force transfer assembly returning the cable to the retracted rest position.

2. The device according to claim 1, wherein the force transfer assembly comprises a reel for receiving the cable, fixed on a second shaft rotatable on the base or the moveable frame.

3. The device according to claim 2, wherein the force transfer assembly further comprises a belt drum fixed on the second shaft; a belt extending between the belt drum and the moveable frame, whereby rotation of the reel by the cable results in rotation of the belt drum and wrapping of the belt around the belt drum, which pulls the moveable frame forward sliding the moveable frame upwardly on the raised front end of the base.

4. The device according to claim 3, wherein the force transfer assembly further comprises circular gears on the second shaft, and a rack gear on the underside of the upwardly sloped front end of the moveable frame, whereby rotation of the reel by the cable results in rotation of the circular gears into engagement with the rack gear, which pulls the moveable frame forward sliding the moveable frame upwardly on the raised front end of the base.

5. The device according to claim 2, wherein the reel comprises a chain drum, and the cable comprises a chain;

wherein an end of the chain is fixed to the chain drum; and wherein the chain drum has a width, whereby the chain wraps upon itself with increasing diameter when in the retracted rest position.

6. The device according to claim 2, wherein the reel comprises a chain drum, and the cable comprises a chain;

wherein an end of the chain is fixed to the chain drum; and wherein the chain drum has a width, whereby the chain wraps spirally around the chain drum with a constant diameter when in the retracted rest position.

7. The device according to claim 2, wherein the reel comprises a sprocket, and the cable comprises a chain;

wherein an end of the chain is fixed on an inside of a canister; and whereby the chain wraps around the sprocket and into the canister, when in the retracted rest position.

8. The device according to claim 1, wherein the base comprises a stationary support, and a sliding carriage slideable on the stationary support; and wherein the sliding carriage includes the raised front end of the base for supporting the front end of the moveable frame.

9. The device according to claim 8, further comprising a sloped surface on the rear end of the moveable frame, whereby the rear end of the moveable frame moves upwardly relative to the sliding carriage when the first force is applied via the handle.

10. The device according to claim 9, wherein the sloped surface is at a first acute angle to the horizontal, and wherein the sloped surface is pivotable relative to the moveable frame, whereby the first acute angle is adjustable.

11. The device according to claim 8, wherein the sliding carriage includes wheels at the front end and the rear end thereof for sliding on the stationary support; and wherein the moveable frame includes wheels at the rear end thereof for sliding on the sliding carriage or the stationary support.

12. The device according to claim 8, wherein the sliding carriage includes wheels at the front and rear ends; and wherein the stationary support includes left and right tracks for receiving the wheels with a slight upward rise adjacent to the front and rear ends thereof to gradually slow forward and rearward movement of the sliding carriage and the moveable frame.

13. The device according to claim 1, wherein a rear end of the moveable frame is slideable on the base enabling the moveable frame to move along the horizontal rear end of the base towards and away from the front of the base.

14. The device according to claim 13, further comprising a sloped surface on the rear end of the moveable frame, whereby the rear end of the moveable frame moves upwardly relative to the base when the first force is applied via the handle.

15. The device according to claim 14, wherein the sloped surface is at a first acute angle to the horizontal, and wherein the sloped surface is pivotable relative to the moveable frame, whereby the first acute angle is adjustable.

16. The device according to claim 13, wherein the rear end of the moveable frame includes a first set of wheels for engaging the base; and wherein the front end of the base includes a second set of wheels for engaging an underside of the upwardly sloped front end of the moveable frame.

* * * * *